US005279352A

United States Patent [19]

Graham et al.

[11] Patent Number: 5,279,352

[45] Date of Patent: Jan. 18, 1994

[54] ELECTROSTATIC APPLICATION OF INSULATIVE REFRACTORY DUST OR POWDER TO CASTING BELTS OF CONTINUOUS CASTING MACHINES—METHODS AND APPARATUS

[75] Inventors: Thomas S. Graham, Shelburne; Wojtek Szczypiorski; Jerome B. Allyn, both of Colchester; Dean A. Boozan, Waterville; George Desorcie, Westford; Norman Bergeron, Burlington; R. William Hazelett, Colchester; John Pennucci, Grand Isle; S. Richard Hazelett, Colchester, all of Vt.

[73] Assignee: Hazelett Strip-Casting Corporation, Colchester, Vt.

[21] Appl. No.: 931,824

[22] Filed: Aug. 18, 1992

[51] Int. Cl.[5] ..... B22D 11/06; B22D 11/124

[52] U.S. Cl. ..... 164/481; 164/72; 164/432

[58] Field of Search ..... 164/481, 431, 432, 477, 164/72, 138; 427/460, 475, 482; 118/627, 630, 621

[56] References Cited

U.S. PATENT DOCUMENTS

| | | | |
|---|---|---|---|
| 3,000,752 | 9/1961 | Jackson et al. | 427/460 |
| 3,163,896 | 1/1965 | Rochester et al. | 164/481 |
| 3,536,580 | 10/1970 | La Fave | 118/621 |
| 4,354,451 | 10/1982 | Vöhringer et al. | 118/326 |
| 4,487,790 | 12/1984 | Bergeron et al. | 164/446 |
| 4,545,423 | 10/1985 | Platek et al. | 164/481 |
| 4,749,027 | 6/1988 | Allyn et al. | 164/481 |
| 5,033,532 | 7/1991 | Aoyama | 164/138 |

FOREIGN PATENT DOCUMENTS

| | | | |
|---|---|---|---|
| 0249250 | 10/1989 | Japan | 164/481 |

*Primary Examiner*—Paula A. Bradley
*Assistant Examiner*—Erik R. Puknys
*Attorney, Agent, or Firm*—Parmelee, Bollinger & Bramblett

[57] ABSTRACT

Electrostatic application of a dusting of dry, self-adhering, thermally and electrically insulative powder particles over a work face of an endless, thin, flexible, water-cooled, metallic casting belt advantageous for use in a continuous metal-casting machine. A dry dusting of protective powdery refractory substance is applied to the belt after being rendered airborne and electrostatically charged by various embodiments of suitable electrostatic apparatus. The casting belt to be dusted is electrically grounded for attracting the charged powder particles for adhering them to the casting belt. The dusting so deposited is remarkably uniform over a substantial area, a phenomenon explainable by mutual electrostatic repulsion of the dry powder particles being deposited. Continuously re-applied dusting over the work face of an endless casting belt during a cast provides an immediately useful repair of lost dusting powder. The dusting may be removed at will by means of an air knife. Certain powders that are effectively soft afford high thermal insulativity for the metallic casting belt, and desirably they cause only minimal interference with further mechanical processing of a cast metallic product into which they might inadvertently become entrained.

59 Claims, 9 Drawing Sheets

FIG. 8
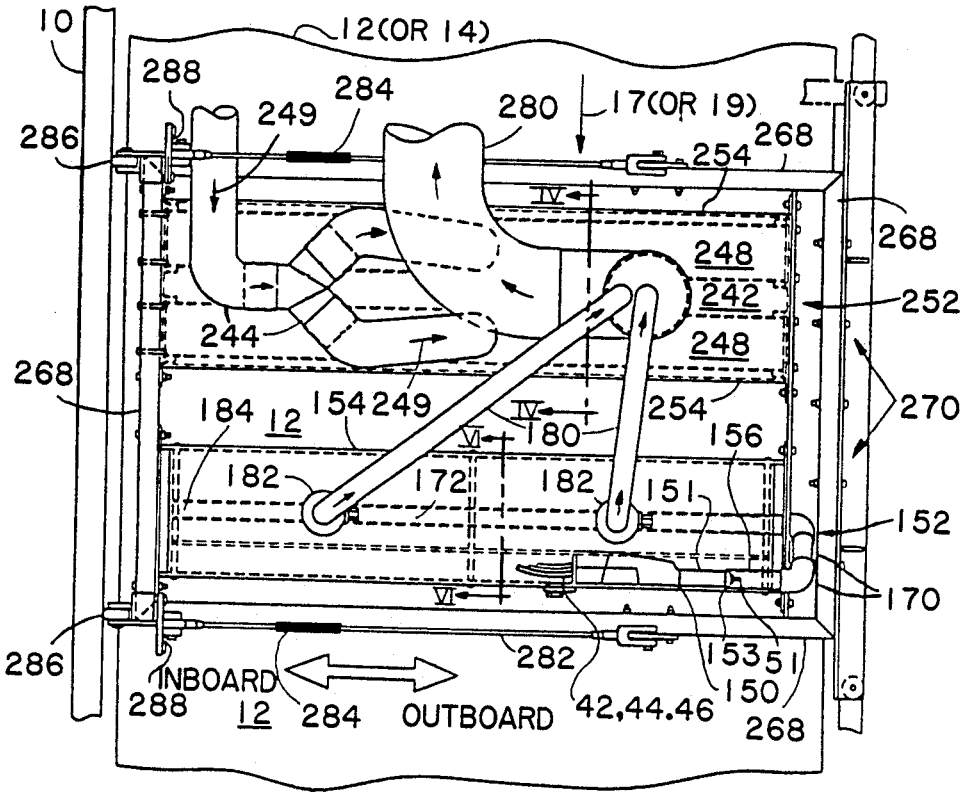
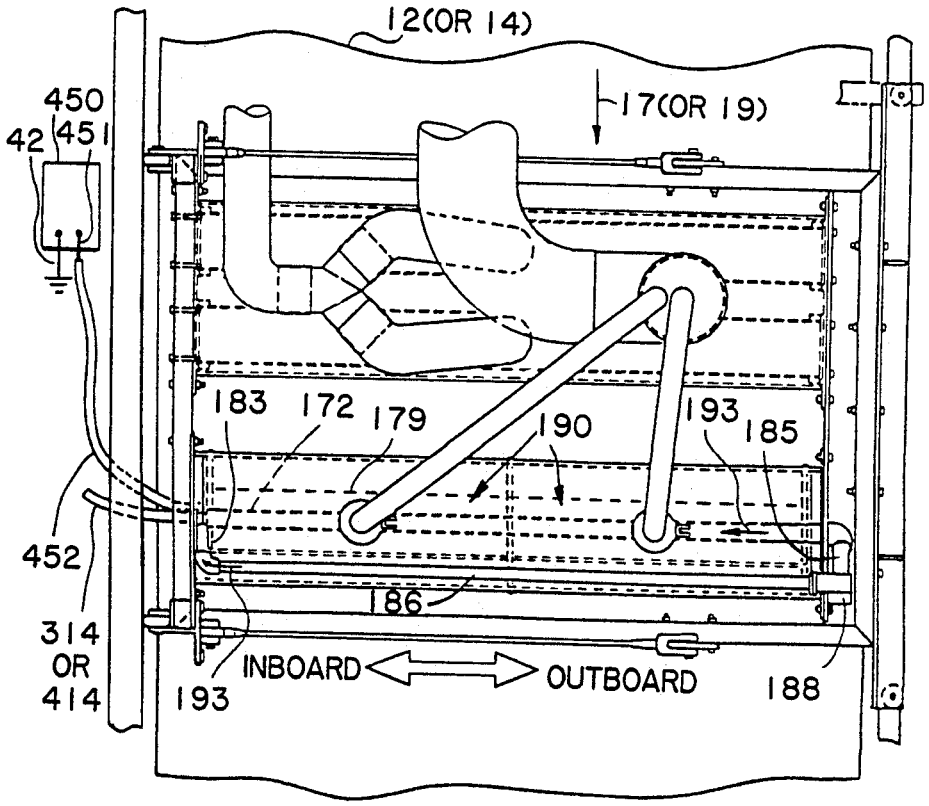
FIG. 8A

ELECTROSTATIC APPLICATION OF INSULATIVE REFRACTORY DUST OR POWDER TO CASTING BELTS OF CONTINUOUS CASTING MACHINES—METHODS AND APPARATUS

FIELD OF THE INVENTION

The present invention is in the field of continuous casting of molten metal in belt-type machines using one or more relatively wide and thin-gauge, flexible, metallic casting belts for defining a moving mold cavity. More particularly, this invention relates to method and apparatus for electrostatic application of insulative refractory dust or powder, notably soft powders, to such relatively wide, thin-gauge, flexible metallic casting belts and to the resulting dusted casting belt itself.

BACKGROUND OF THE INVENTION

This invention is for the improvement of the operation of belt-type continuous metal-casting machines. The specification will proceed in terms of describing a twin-belt casting machine as disclosed in U.S. Pat. Nos. 4,588,021 and 3,937,270.

In a thin-gauge-belt-type casting machine, one or more moving, endless, thin, flexible, metallic, water-cooled casting belts successively enter and leave a moving mold cavity. During the casting of molten metal, a flat casting belt is very important. The problem of belt flatness vs. distortion or warping arises because of thermal heat expansion of the belts when the belts enter into contact with molten metal. The casting belt or belts must remain flat and free from distortion or warping, lest the freezing metal lose contact here and there and thereby interrupt the heat transfer locally, causing metallurgical problems. The warping problem is discussed in U.S. Pat. Nos. 3,937,270, 4,537,243 and 4,749,027, all assigned to the same assignee as the present invention.

Insulative, non-wetting belt coverings have been, and continue to be, part of the strategy to eliminate this problem of belt warping or distortion. These include permanent precoverings or base coverings (hereinafter called "basings"). These are described in U.S. Pat. No. 4,588,021 of Bergeron et al. and the more or less temporary top deposits or top dressings or temporary insulative deposits or toppings or mold-release agents, which are applied on top of a basing. All prior-art top or temporary insulative deposits known to us wear and compact and flatten unevenly and thus soon require replenishment or replacement. Manual replenishment of the unevenly worn or flattened spots does not in practice result in re-establishing a top deposit that affords uniform heat transfer. Nor has it been feasible to strip and reapply the prior-art insulative toppings, which usually comprise a binder.

Most of the prior-art top deposits were applied wet. Thus, residues of liquid resulting from such wet applications would sometimes flash into gas and cause porosity or other problems in the cast product. In the casting of copper bar or copper anodes, synthetic oils upon otherwise bare metallic casting belts have been customary, sometimes resulting in similar porosity problems. None of the prior art known to us can achieve the unique results disclosed herein.

SUMMARY OF THE DISCLOSURE

The problems of an easily applied and maintained top insulative deposits for water-cooled, thin-gauge flexible casting belts and for edge dams are solved or substantially overcome by the present invention, in which suitable, finely-powdered refractory substance is applied and re-applied by means of high-voltage electrical apparatus which imparts charge to the dry powder or dust particles in flight, such that they disperse from each other in a generally uniform distribution before being attracted to the casting belt and landing upon it. The dry particles adhere evenly to the casting belt in a self-leveling fashion 'over a wide area. Electrostatic re-application of more powder particles results in the beneficial, uniform self-healing of wear spots. Yet all the powder particles can be removed and replaced continually according to need.

BRIEF DESCRIPTION OF THE DRAWINGS

Other objects, aspects, features and advantages of the present invention will be apparent from the following detailed description of the presently preferred embodiments considered in conjunction with the accompanying drawings, which are presented as illustrative and are not intended to limit the invention. In particular, the specification will proceed in terms of a twin-belt casting machine and usually in terms of the upper carriage of such a casting machine. Corresponding reference numbers are used to indicate like components or elements throughout the various Figures. Large outlined arrows point "downstream" relative to the longitudinal direction (upstream-downstream orientation) of the moving casting mold cavity, and thus they indicate the direction of product flow from entrance into the moving mold cavity to exit therefrom. Normally, the direction of flow of cooling water also is in the "downstream" direction. Plain single-line arrows show the direction of flow of air and powder or dust. Such single-line arrows also show the directions of motion of various components of the casting machine.

FIGS. 3 through 10 show the several additional, embodiments of the invention.

FIG. 3 is a bottom view of a pair of air knife chambers, shown truncated.

FIG. 4 is a cross-section view of a pair of air knife chambers,, sectioned at IV—IV in FIG. 3.

FIG. 5 is an elevation view as seen from the outboard side of an assembly comprising a single-tube gun-injection powdering or dusting station, the two air knives, and exhaust equipment.

FIG. 6 is an enlarged, partial cross-sectional elevation view of the central part of the single-tubular-dispenser powdering or dusting station shown in FIG. 5, with an electrostatic gun. FIG. 6 is a sectional view taken at VI—VI in FIG. 8.

FIG. 7 is an elevation view of the equipment of the assembly shown in FIG. 5, as seen from upstream.

FIG. 8 is a top plan view of the equipment assembly shown in FIGS. 5 and 7.

FIG. 8A is the same as FIG. 8 except that the electrostatic gun is replaced with alternate apparatus, and the single tubular dispenser forms part of a loop for internal rapid circulation of the airborne powder. For clarity of Illustration, reference numbers that appeared in FIG. 8 are not repeated.

FIG. 9 is a perspective view of a fluidizing hopper, together with the rear of a console, as used to feed dust or powder to electrostatic application apparatus.

FIG. 10 is a perspective view of an improved fluidizing "dust-cloud" hopper, together with the rear of a console, for feeding dust or powder from a dust cloud within the hopper to electrostatic spraying apparatus.

DETAILED DESCRIPTION OF THE PREFERRED EMBODIMENTS

Figure 1:
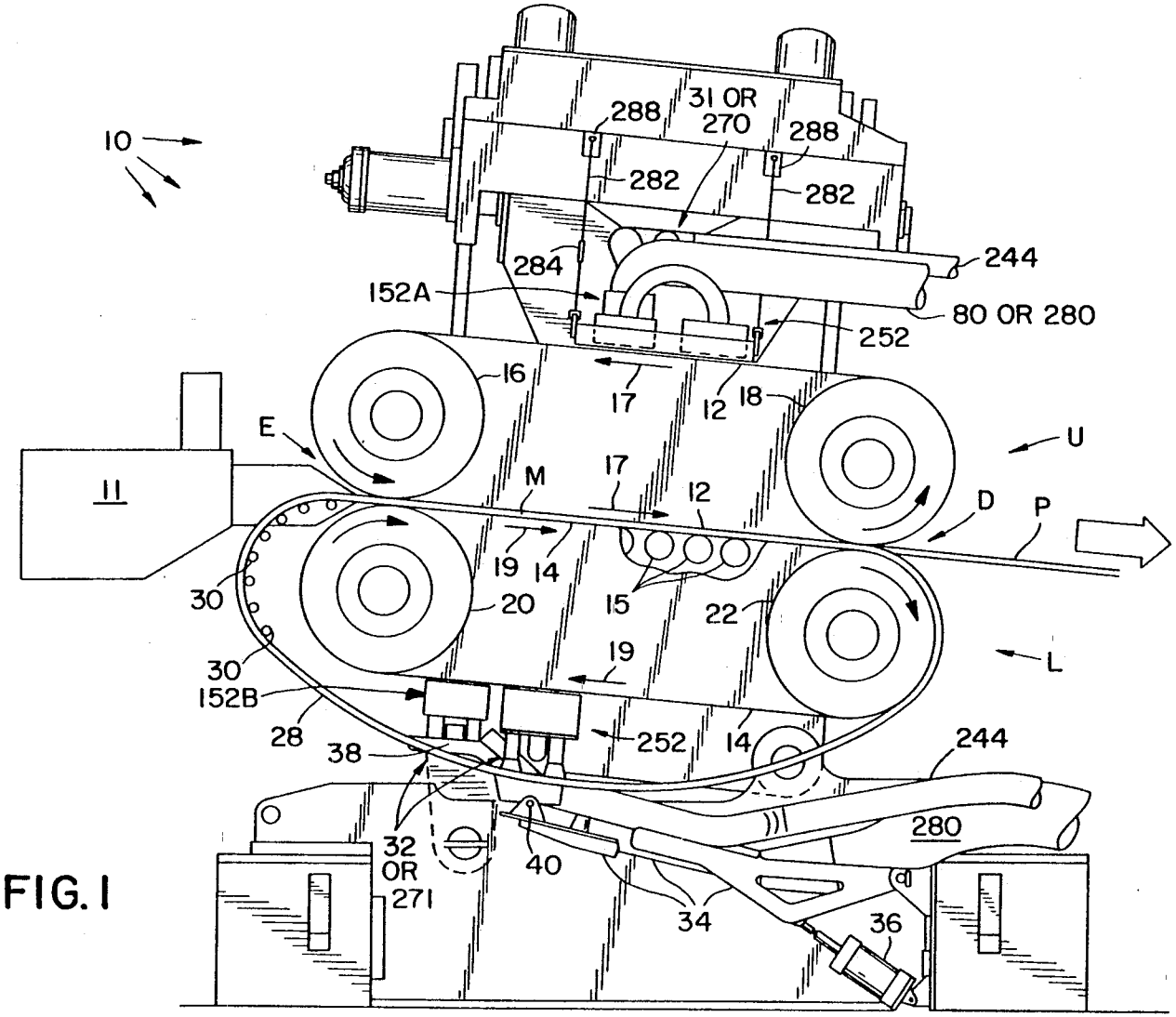
FIG. 1 is an elevation view of a twin-belt casting machine as seen from the outboard side. This machine is shown as an Illustrative example of a relatively wide, thin-gauge belt-type continuous metal-casting machine in which the present invention may be employed to advantage.

In FIG. 1 is shown a belt-type of continuous casting machine, illustratively shown as a twin-belt caster 10. Molten metal is fed from a tundish 11 into a moving mold cavity M at the entry end (upstream) E. Cast metal product P issues from the downstream or discharge end D. (The plane of product P is also denominated spatially as the pass line.) Upper and lower casting belts 12 and 14 define between them a moving casting mold cavity M and are supported and driven by means of upper and lower carriage assemblies U and L respectively. Multiple, freely-rotatable back-up rollers 15 in both carriages U and L guide and support the casting belts 12 and 14 as they move (arrows 17 and 19) along the moving mold cavity M. For clarity of Illustration, only a few of these back-up rollers are shown.

The upper carriage U, as shown in this embodiment of the present invention, includes two main roll-shaped pulley drums 16 (nip pulley drum) and 18 (tension pulley drum) around which the upper casting belt 12 is revolved as indicated by the single-line arrow 17. Similarly, the lower casting belt revolves as shown by arrow 19 around a lower nip pulley drum 20 and a tension pulley drum 22. Two laterally spaced multiple-block, revolving edge dams 28 (only one is seen) travel typically around rollers 30 to enter the moving casting mold cavity M. Coolant water is applied to the inside surfaces of the casting belts 12 and 14, and this coolant travels longitudinally along the inside surfaces of the casting belts 12 and 14, as is known in the art.

The reference numbers henceforth usually apply identically to the components of both upper and lower carriages U and L. The description will generally be in terms of the equipment on the upper carriage U. with the understanding that similar equipment will normally be at an equivalent place in the lower carriage L. As to the apparatus that is attached to the lower carriage, supporting structures will differ from those shown for the upper carriage, partly because the lower belt 14 sags when slack, and it is necessary to keep a slack belt clear of the lower dusting equipment 32 when withdrawing the slackened lower belt to replace it periodically.

Figure 7:
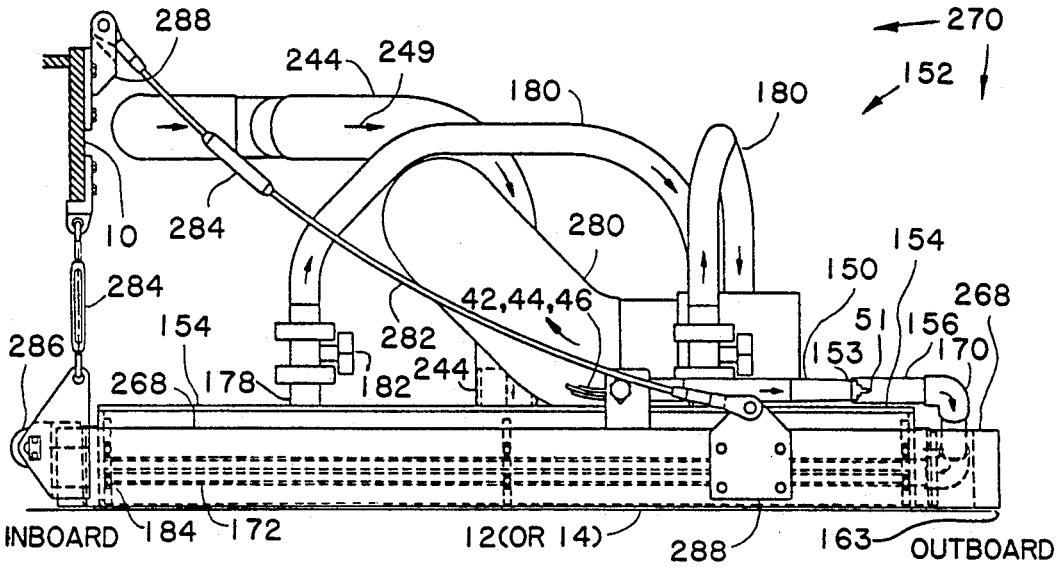
Figure 9:
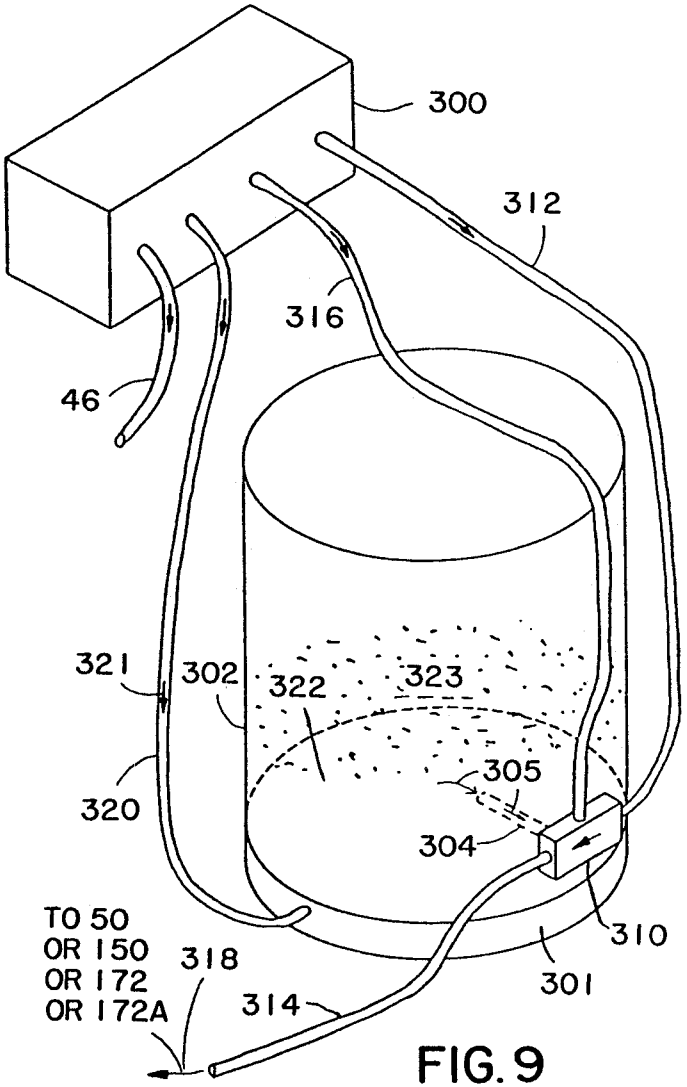

Electrostatic corona-discharge-type paint-powder spray guns 50 (FIG. 2) and 150 (FIGS. 5, 7 and 8) serve well in the first two embodiments of the present invention. Six embodiments of the invention will be distinguished later herein. Voltage that is direct current, or at least unidirectional in polarity, is applied by the spray gun 50 or 150. The gun we use is adjustable to about 100 kilovolts, charging the air and the entrained powder or dust on its way out of the respective gun 50 or 150 by means of a charged electrode, namely, a small-diameter central "corona-discharge" wire 51 (FIGS. 2, 7 and 8), typically 0.55 mm (0.021 of an inch) in diameter, protruding forward at an exit tip of the respective gun. The negative high voltage at the corona-discharge wire 51, which voltage we have used successfully, is produced electrically in a multiplying circuit located right in the gun from a low-voltage, 17 kilohertz alternating-current electric supply line 42 which comes out of the rear of a remotely-located operating console 300 (FIG. 9). A corona discharge is thereby produced at the exit of the gun where the airborne powder particles emerge around the corona-discharge wire 51 which is centrally placed in the exit of the gun 50 or 150.

This corona discharge is a key to the charging of the powder particles (see article by Miller). The voltage required to produce corona discharge is related to the sharpness or rather the radius of the corona-emitting round wire or of the edges of an electrode of other configuration than a round wire. That is, the greater the sharpness of the sharpest parts, or the less the radius on the small-radius parts of the electrode, the less the voltage that is required to produce corona discharge. The work (that is, casting belt 12 or 14) to be dusted is grounded to Earth as indicated at 48 (FIG. 2). else a powder-repelling charge accumulates on the work, and an operator may get a shock.

A single fluidizing hopper 302 (FIG. 9) near a console 300 supplies powder or dust to all electrostatic equipment in an installation. A rigid horizontal suction tube 304 (FIG. 9) draws (following arrows 305) fluidized powder 323 from near the bottom of the hopper 302 and feeds It to an aspirator pump 310, which is here located on the side of the hopper 302. The conveying air for the aspirator pump 310 comes from the console 300 to the aspirator pump through an air-supply hose 312. Emerging from the aspirator pump 310 and carrying a feed of powder is a powder-feed hose 314, which conveys powder-laden air 318 through a hose 44 (FIG. 2) to the respective gun 50 (FIG. 2) or to the single-tube gun 150 (FIGS. 5, 7 and 8) or to tubular dispenser 172 (FIGS. 5A, 6, 6A, 6B, 6C, 6D, 7A and 8A). A suitable rate of flow of air through each gun was measured to be roughly 70 cubic inches per second (70 liters per minute).

Figure 2:
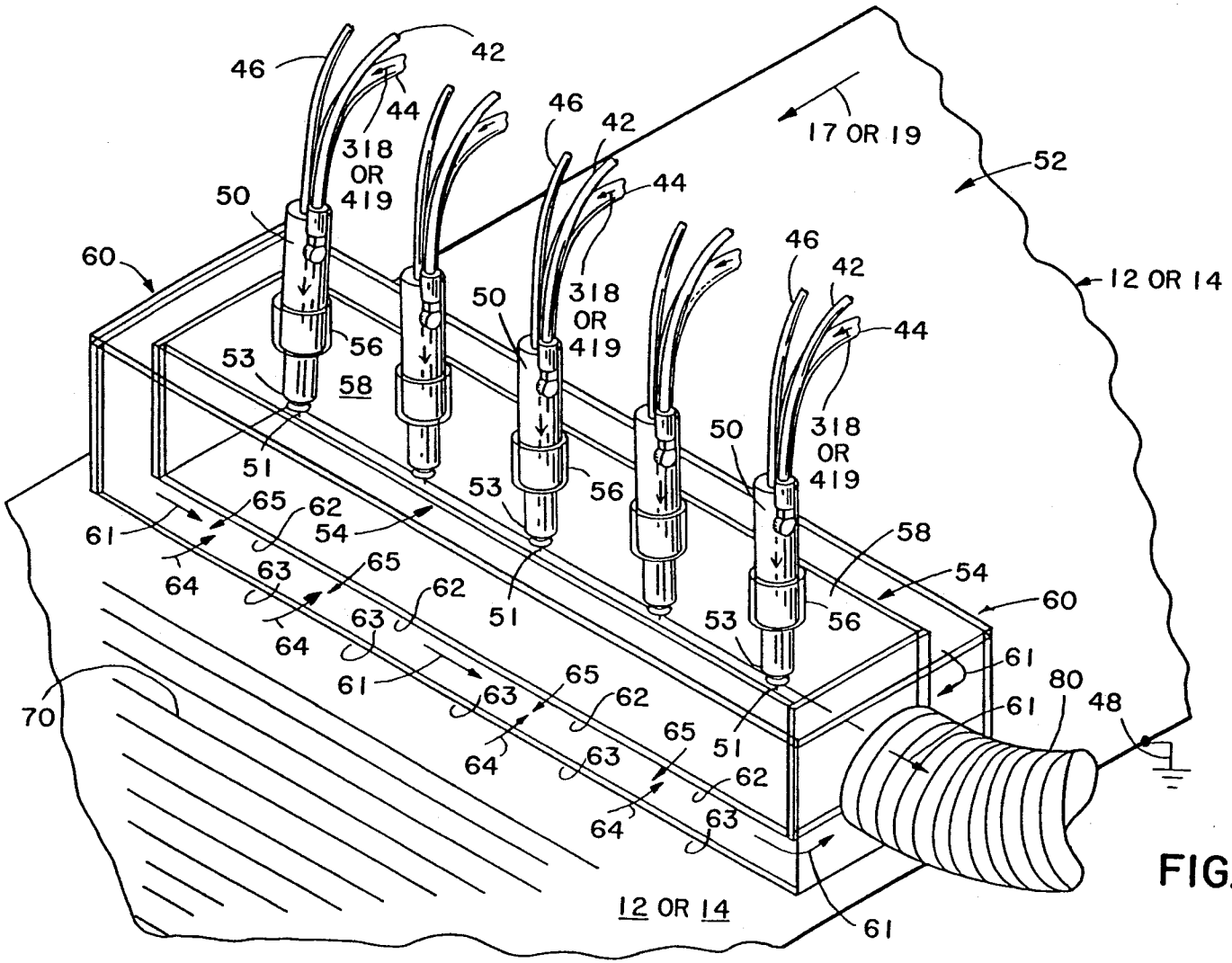
FIG. 2 is a perspective view of a multiple-gun, direct-applying, "high-rise" station for electrostatically distributing and adhering refractory powder or dust to a flexible casting belt which in this instance is the upper belt of a twin-belt casting machine. For clarity of illustration, the box portion of the equipment in this station is shown as being transparent. The box is positioned with its length extending across the casting belt from one margin of the belt toward the other margin.

In the multiple-gun direct-applying "high-rise" station 52 (FIG. 2) there are shown five electrostatic spray guns 50. For each gun there is a remotely-located operating console 300 and an aspirator pump 310. In other words, for supplying these five guns 50, there is one hopper 302, and associated with this one hopper there are five consoles 300, five aspirator pumps 310, five powder-feed hoses 314, five suction-reducing hoses 316 and a fluidizing hose 320 for keeping the mass of powder 323 suitably fluidized. It is noted that the five respective powder-feed hoses 314 to the guns are indicated in FIG. 2 by the reference numbers 44.

For providing fine control, a supplementary hose 316 from a console 300 adjustably reduces suction of the aspirator pump 310 by adjustably "breaking the vacuum" therein. A fluidizing line 320 from a console 300 leads into the bottom of the hopper 302 for passing air or other suitable gas into plenum 301 and upwardly through a fluidizing porous sheet 322 extending across the whole area of the bottom of the hopper 302. The thickness of porous sheet 322 is for example 6 millimeters (0.25 inch). A reference number 323 indicates the fluidized mass of powder shown dotted within the hopper 302. The pressure of the fluidizing air or gas (arrow 321) flowing through the hose 320 and then passing up through the porous sheet 322 is a fraction of atmospheric pressure, for example, being in a range from about 4 to 5 pounds per square inch (0.27 to 0.34 bars). The air or gas 321 that fluidizes and the air or gas that conveys the powder or dust 318 must be quite dry and quite free from oil.

The electric aspect of the guns is easily managed and easily rendered uniform among more than one gun in use at a time. The rate of powder flow (arrow 318, FIG. 9) from the fluidized hopper 302 has not been so easily managed. At the extremely low rates of powder flow required for electrostatic application to even a relatively wide, thin-gauge flexible metallic casting belt 12, control of the rate has been difficult and hardly repeatable, when employing fluidizing hoppers 302 as shown in FIG. 9.

Figure 10:
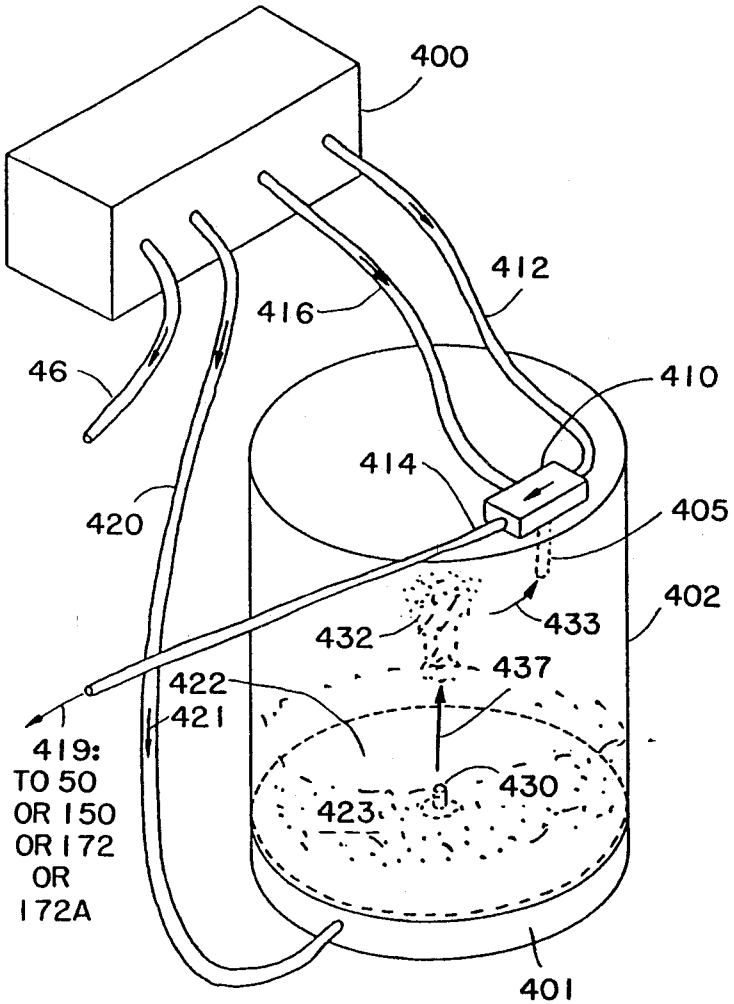

Our further improvements to the above-described apparatus of FIG. 9 are shown in FIG. 10, where a fluidizing hopper is indicated by 402. A novel concept is to draw powder or dust from a "dust cloud" (instead of directly from a fluidized mass of powder 323, FIG. 9). This dust-cloud provides powder-flow dynamics which Improve control at our extremely low powder-flow rates. Fluidizing air or gas 421 from a fluidizing line 420 passes through plenum 401 and then upwardly through a porous sheet 422 extending across the whole bottom of the hopper 402 for producing a mass of fluidized powder 423. Some of the fluidizing air or gas 421 from the line 420, though it goes through plenum 401, does not pass through the porous sheet 422 but passes instead through a "fountain" consisting of a small-diameter nozzle exit 430 that is here shown as extending upward from the center of the porous sheet 422 so as to be buried in the mass of fluidized powder 423. The exit orifice 430 is here shown aimed vertically upward for creating a kind of fountain powder-cloud 432. An emerging jet of air or gas 437 from nozzle orifice 430 renders some of the mass of fluidized powder 423 in the hopper airborne in an elevated fountain-like cloud of dust 432 which is suspended turbulently above the fluidized mass 423. The exit of the nozzle 430 is conveniently about 0.8 mm (0.030 of an inch) in internal diameter. The pressure of the air flow for creating the fountain jet 437 is the same as that for fluidizing the powder 423 through air passing up through porous sheet 422, that is, in the range from about 4 to 5 pounds per square inch (0.27 to 0.34 bars). Hence, no separate air supply need be made for the nozzle 430. However, the fluidizing air or gas through sheet 422 and jet 327 ultimately tends to come out of the top of the hopper 402. Under some conditions, this air or gas entrains some powder and so must be exhausted and filtered. The connections and equipment to accomplish this are not shown.

A relatively short, rigid suction tube 405 projecting down from the top of the hopper draws some powder-containing air (arrow 433) from this dust-cloud 432. This powder-containing air 433 goes to an aspirator pump 410. The conveying air for the aspirator pump 410 comes from a console 400 to the aspirator pump through an air-supply hose 412. Emerging from the aspirator pump 410 carrying an extremely low feed-rate (arrow 419) of powder is a powder-feed hose 414. This powder-feed hose is conducting air or gas, carrying an extremely diluted flow of powder 419 to the respective gun 50, as shown by the connections 44 in FIG. 2 or to the single-tube gun 150 or to the tubular dispenser 172. For providing fine control, a suction-reducing hose line 416 from the console 400 can reduce suction of the aspirator pump 410 by adjustably breaking the vacuum therein. A single hopper 402 and a single dust-cloud 432 and a single orifice 430 and a single jet 437 serve to supply all of the guns in an installation. However, there are as many consoles 400, as many aspirator pumps 410 as there are guns 50 or 150 or tubular dispensers 172 in an installation. Each aspirator pump 410 has its accompanying hose lines 412, 414 and 416 and its accompanying suction-intake short-tube 405.

Casting belts that are ready for applying dustings according to the present invention may be either bare or else precoated notably with thermally sprayed refractory substances which we call "basings," according to U.S. Pat. Nos. 4,537,243, 4,487,790 or 4,487,157. These patents are assigned to the same assignee as the present invention. Such thermally applied basings underly the presently disclosed temporary insulative deposit of a dust cushion of dry insulative particles. However, limited success has been attained by using a top deposit according to the present invention and without any underlying basing, i.e. on a bare metallic casting belt.

We have been successful in using six embodiments of the invention for electrostatic application of thermally-insulative refractory powder or dust onto relatively wide casting belts 12. We shall describe all six embodiments.

The first embodiment of the invention involves a multiple-gun, direct-applying, "high rise" station 52 (FIG. 2). To cover a "casting width" of 52 inches (1320 mm), five electrostatic powder spray guns 50 emit charged powder or dust within the confines of solid interior walls of a bottomless spray box 54 (FIG. 2). This box 54 is about 10 inches (250 mm) wide and is as long as the "casting width" on a casting belt 12 to be dusted. This box 54 is mounted so that its length extends across the moving casting belt 12 to be dusted. Each gun 50 applies dust or powder to about 10 inches of casting-belt width. Thus, there are five such guns to cover a "casting width" of 50 inches. The total width of the casting belt 12 is at least about eight inches wider than the "casting width."

Plastic non-conducting mounting nipples 56 hold the guns onto the box 54. The box 54 is made of nonconductive material such as a suitable plastic, or at least the box 54 is internally lined with a suitable non-conductive material. We have successfully used relatively rigid sheets of commercial polyvinyl chloride plastic material for constructing the box 54. We have found that a box 54 made from such PVC plastic material does not "compete with" the casting belt 12 for attracting the charged powder or dust. The guns are mounted by the nipples 56 in a roof 58 of the box 54 and are pointed toward the moving casting belt 12 to be dusted. The discharge snouts 53 of the guns 50 are positioned about 10 inches (about 250 millimeters) above the belt 12.

A dispensing gun 50 or 150 which can be employed to advantage in the multi-gun, direct-applying station 52 or in a single-tube powdering or dusting station 152A or 152B (described later) is an electrostatic powder spray gun as described earlier herein, which has a sharp-ended corona-discharging electrode in the form of wire 51. A hose line 46 (FIGS. 2, 9 and 10) extends to each gun 50 in the station 52 for supplying "rinsing air" to each gun to keep the electrode unclogged, as is known in the art.

A bottomless but otherwise enclosed arcade or buffer region 60 extends along or around the perimeter of the bottomless spray box 54. The enclosed arcade 60 is subject to continuous suction through a large-diameter exhaust hose 80 which is connected into remote filtering and dust-collecting equipment (not shown). In such remote filtering equipment, we use dry, surface-treated filters that are self-cleaning by discharge into a hopper located below the filters. Frequent, programmed puffs of back air pressure dislodge the dust or powder so accumulated.

The purpose of the enclosed corridor or arcade 60 coupled to the exhaust hose 80 is for preventing airborne particles from escaping into the atmosphere from clearance gaps 62 preferably about 0.12 of an inch (3 millimeters) located between the moving (arrow 17 or 19) casting belt 12 or 14 being dusted and the bottom edges of the walls of the bottomless spray box 54. An approximately 0.08 of an inch (2 millimeters) clearance gap 62 is about the minimum gap practicable as a predetermined clearance for protecting a dust-cushion distribution 70 from being undesirably scraped. Over about 0.32 of an inch (8 millimeters), the effectiveness of the gap is compromised.

In FIG. 2 the casting belt 12 or 14 is illustratively shown moving in a right-to-left direction as indicated by the arrow 17 or 19. The casting belt emerges from beneath the multiple-gun direct-applying station 52 with an applied uniform distribution 70 of thermally-insulative refractory dust or powder electrostatically adhered thereto. The suction (arrows 61) of air drawn by the large-diameter hose 80 from the external corridor or arcade 60 is enough to draw air (arrows 64) from the environment reliably into the corridor or arcade, both at gaps 63 located below the bottom edges of the periphery of the corridor and also to draw air (arrows 65) through similar gaps 62 located below the perimeter of the inside bottomless spray box 54. A suction of no more than about three inches (about 75 mm) of water-column is sufficient. Too much suction undesirably disturbs the uniformly distributed powder 70 on the moving casting belt 12 or 14.

For narrower casting belts, the multiple-gun, direct-applying station 52 is arranged with less than five guns, such that there is one gun for each nine to ten inches of casting width. Powder is normally applied also to the working surfaces of the edge dams 28 (FIG. 1), for example for the continuous casting of copper bar.

Figure 5:
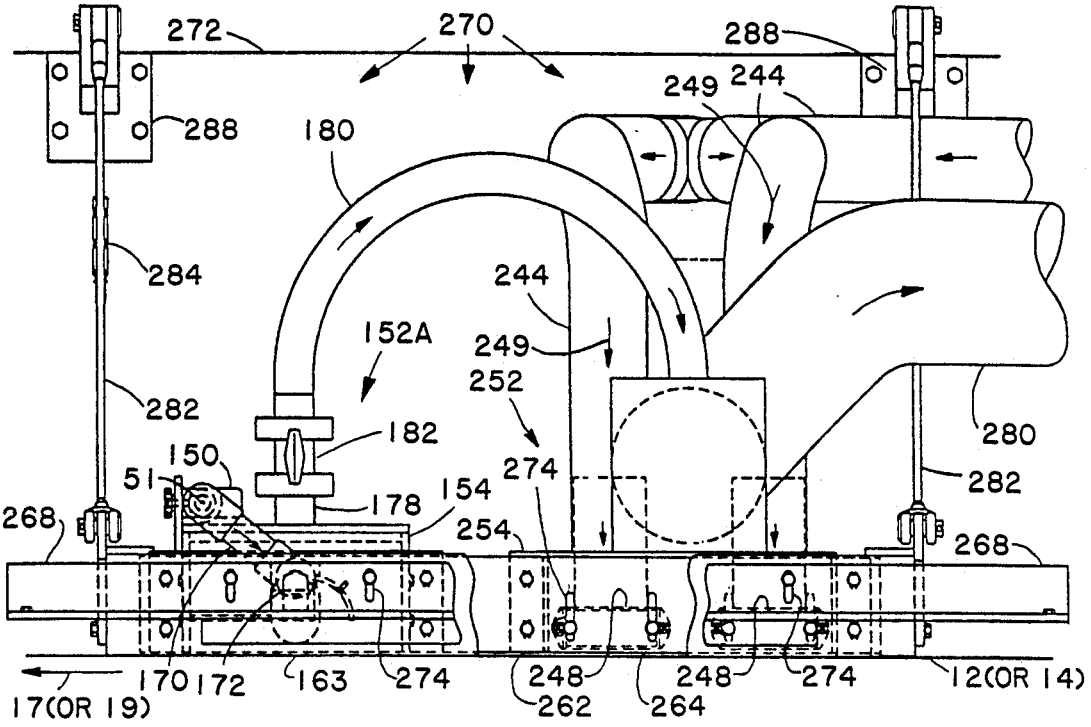

The second embodiment of the invention involves a single-tube, gun-injection powdering or dusting station, indicated generally at 152A and 152B (FIGS. 5. 7 and 8). Only a single electrostatic spray gun 150 per casting belt is normally used. Its snout 153 (FIGS. 7 and 8) is inserted into a nipple 156 of plastic non-conductive material, whence the airborne stream of charged powder or dust passes through nipple 156 which is plastic acting as an insulator. The powder arrives into a tubular dispenser 172 which is preferably ungrounded and electrically conductive, most conveniently metal. This tubular dispenser 172 has a row or series of suitably sized and spaced powder-dispensing holes, slots or other apertures, for example a row of 0.062-inch (1.58 mm) diameter holes 174 (FIG. 6) spaced along the length of the tube at a pitch of about 0.5 inch (about 13 mm). This row of holes 174 extends along a length of the tube 172 corresponding to the casting width on the belt 12 or 14.

A curved deflector 176 (FIG. 6) made from a quadrant of a pipe is attached to the tubular dispenser 172, going the working length of the tube. The curved deflector 176 directs an air or gas flow of powder or dust 167 toward the belt 12 or 14 to be dusted. We have found that direct impingement of the Jets 175 without the deflector 176 usually results in undesirable streaks on the belt, a streak for each hole 174. The holes 174 are not aimed to shoot powder directly straight toward the casting belt 12. Instead, the holes 174 are now directed generally parallel with a nearby portion of the inside surface of the curved deflector 176. As shown by an arrow 175 (FIG. 6), the holes 174 are directed to shoot the powder or dust generally tangentially along the inside surface 177 of one of the curved walls constituting curved deflector 176 wherein each stream 175 spreads out laterally in a direction across the belt width. The powder so emitted leaves the curved deflector inside surface 177 tangentially. The curved deflector 176 stands off from the belt 12 or 14 by the gap 162 which is about 1.4 inch (about 35 mm) in size.

The third embodiment of the invention is the single tube, long-separate-electrode mode. No gun 50 or 150 is used; this is a significant variation from FIGS. 5, 7 and 8. A transversely oriented corona-discharge-producing electrode—for instance, one or more corona-discharge wires 179 (FIGS. 5A, 6A and 8A)—is placed near to curved deflector 176 and is spaced from the work face of the casting belt in the path of the powder particles (arrow 175) that come airborne out of tubular dispenser 172. The wire 179 may conveniently be made of 0.012-inch (0.3 millimeter) diameter wire of austenitic stainless steel. The corona-discharge wire 179 is stretched the length of the curved deflector 176 (FIGS. 5A, 6A and 8A) in such a way that the oncoming powder (arrow 175) to be adhered to the casting belt passes close by it. The wire 179 lies conveniently near the concavity 177 near its powder-guiding exit edge 191, as shown in FIG. 6A and is spaced about 0.4 of an inch (10 millimeters) away from edge 191. This long corona-discharge wire 179 is charged by a high-voltage power supply 450. Either polarity has been satisfactory. When the corona-discharge wire 179 is used without any gun, the hose line 314 or 414 goes directly to the tubular dispenser 172 which may in this embodiment be made of either conductive or nonconductive material, though it should not be grounded lest extra corona-discharge current unduly load the power supply 450.

The air or gas pressure within distributing tube 172 should not be greater than about one inch (about 25 millimeters) of water column. Rinsing air hose 46 is not used in this single-tube, long-separate-electrode embodiment shown in FIG. 6A. The corona-discharge wire (or wires) 179 may be removed and one (or more) conductive grids or plates placed in its stead as another kind of electrode, but the wire 179 is our most preferred mode. According to electrostatic theory, a smaller-diameter wire electrode 179 would enable lower voltages to be used. In any case, the electrode voltages used for electrostatic application of insulative refractory dust or powder to a casting belt are corona-discharge-producing voltages. A corona-discharge-producing power supply 450 has its high voltage terminal connected to corona wire 179, as indicated via a conductor 451, having a suitable insulation jacket 452.

Figure 6:
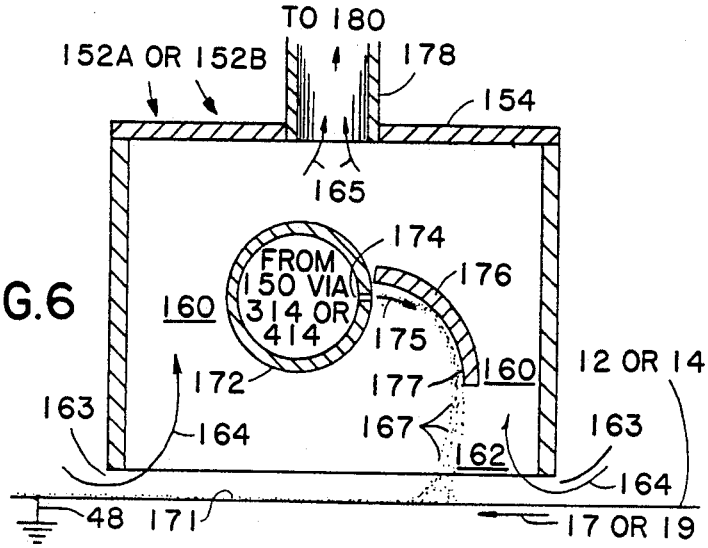
Figure 6A:
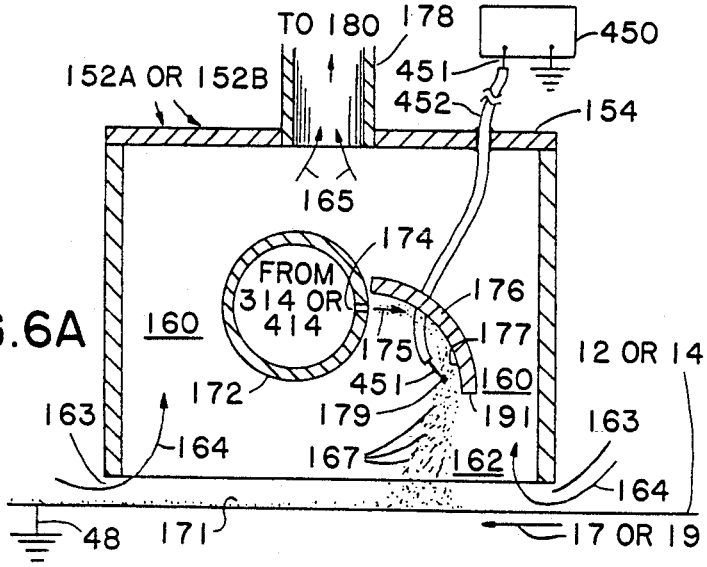
FIG. 6A is the same as FIG. 6 with the addition of a corona-discharge wire as an electrode but with no electrostatic gun.
Figure 6B:
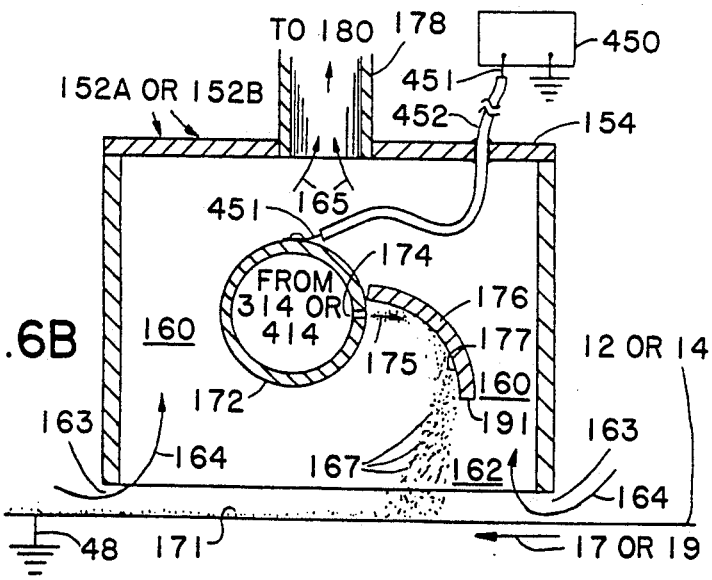
FIG. 6B is the same as FIG. 6 but with the single tubular dispenser being also an electrode but with no electrostatic gun or corona-discharge wire.

In FIG. 6B is shown the fourth embodiment of the invention, which is the single-tube-as-electrode mode. It is like the single-tube, long-separate-electrode embodiment described above and illustrated in FIGS. 6A and 8A, except that the corona-discharge wire 179 is omitted. Instead, an electrically conductive, ungrounded, insulated tubular dispenser 172 itself functions as the electrode. It is electrified as was the corona-discharge wire 179 in FIG. 6A. It is our theory that the burrs or sharp edges at the entrances and exits of holes 174 may act as desirable emitters of corona discharge and so should not be quite blunted.

In all of the single-tube modes described herein, an external buffer region or arcade 60 or 160 is internally kept at a below-atmospheric pressure of about 3 inches (about 75 millimeters) of water column through a flow of air 165 by means of exhaust tube connections 178 (FIGS. 5, 6 and 7), regulating valves 182 and exhaust ducts 180 which lead into a large diameter exhaust hose 280 going ultimately to a dust collector (not shown). The dust collector intermittently cleans itself by puffs of reverse air pressure as described above in connection with the multi-gun, direct-applying station 52 (FIG. 2). As occurs with bottomless spray box 54 described above, this buffer region (or arcade) 160 prevents airborne particles from escaping into the atmosphere through clearance gaps 163 of about 0.08 to 0.32 inch (about 2 to about 8 millimeters) between the bottom edges of the walls 154 of the buffer region 160 and the casting belt 12 or 14. Air flow 164 through gaps 163 prevents the escape of powder particles into the atmosphere.

Powder will settle out and pile up in the lower portion of tubular dispenser 172 under the influence of gravity if not prevented. It is desirable to limit accumulations of powder, since accumulations may emerge untimely, resulting in uneven deposition. Moreover, accumulated stagnant powder sometimes has an undesirable electrical influence on other powder particles.

Figure 6C:
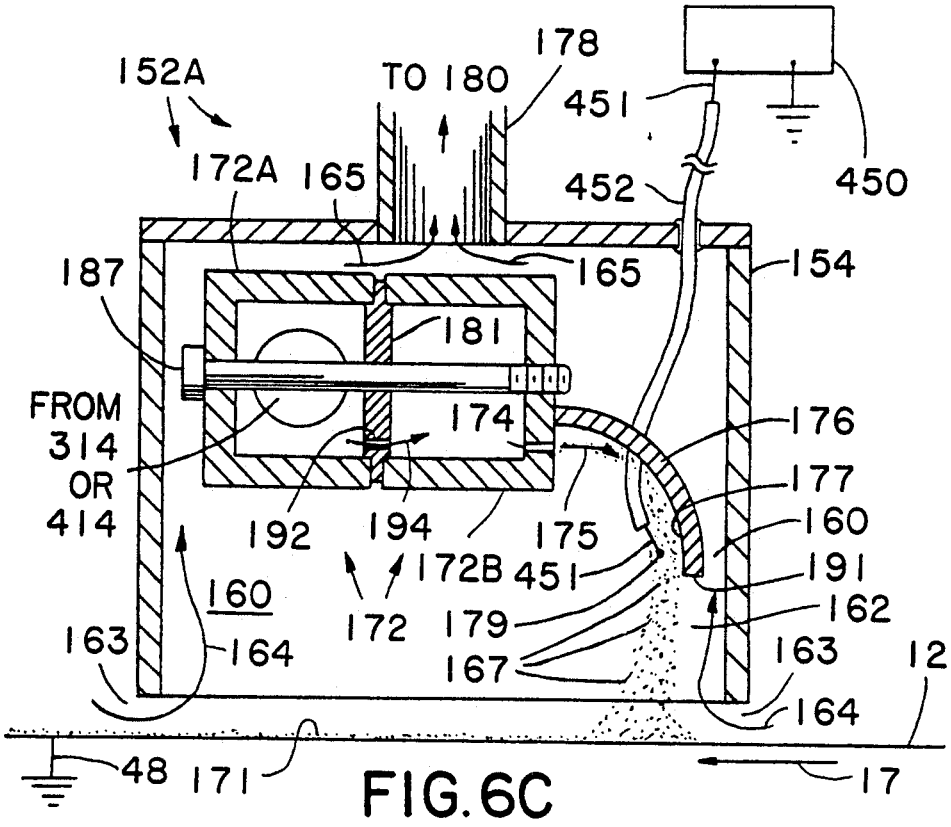
FIG. 6C is the same as FIG. 6A but with the single tubular dispenser replaced with a double-chambered tube assembly, the two chambers being separated by an equalizing baffle.

There are two general ways to meet the dust-settlement problem in dispensing tube 172. The first way is the split-tube mode, which is to manufacture the tube 172 in two pieces: an antechamber tube part 172A and an exit chamber tube part 172B, as shown in FIG. 6C. Hence, dispensing tube 172 becomes split along its length in a direction that conveniently may be perpendicular to the pass line P. Powder feed hose 314 or 414 goes into antechamber tube part 172A as indicated by a legend and bears a powder-charged airstream 318 or 419. An intermediate baffle plate 181 separates the two dispensing-tube parts 172A and 172B and is conveniently sandwiched between these two tube parts fastened by machine screw 187. A row or series of holes or other apertures 192 in baffle 181 is positioned low, i.e., near the bottom of the baffle 181. The low position of these intermediate holes 192 causes the powder-charged airstream 194 to entrain settled powder particles 196 and 198 and hence desirably to limit their accumulation. The total area of the holes or apertures 192 in baffle 181 is comparable to the total area of the exit holes 174 discussed below; this evenness brings about even distribution of powder regardless of the location of the inlet from lines 314 or 414.

Figure 6D:
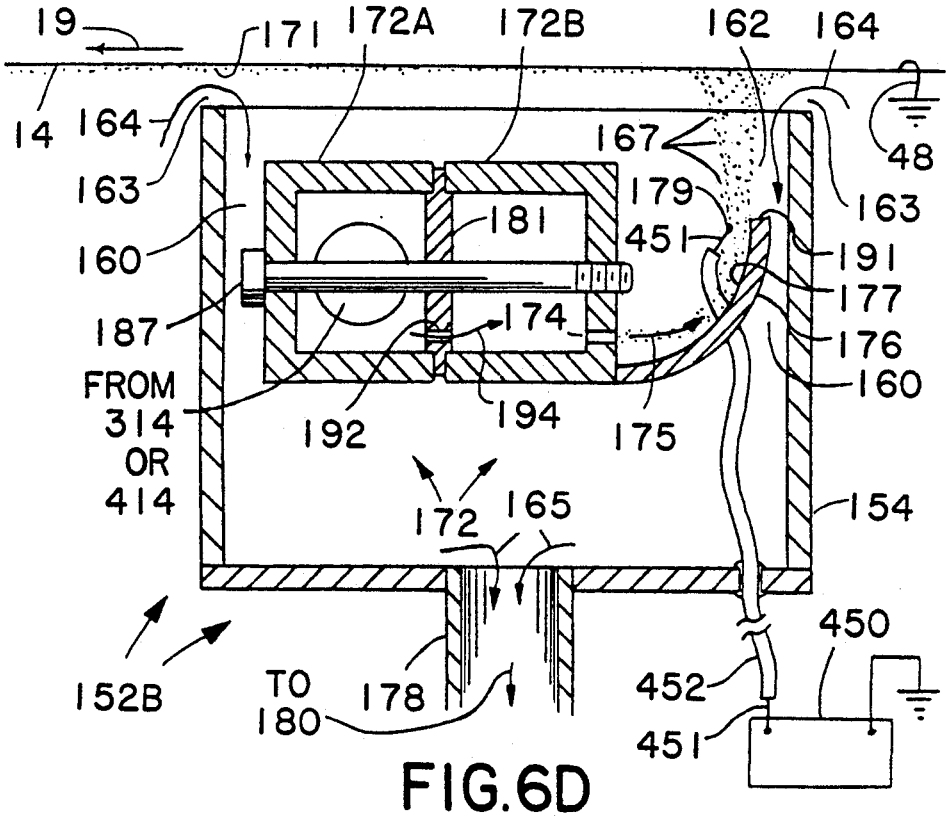
FIG. 6D is like FIG. 6C but with adaptations for the lower belt.

The exit holes 174 are placed low in the exit tube part 172B. Their low placement similarly enables airstream 175 to entrain settled powder particles 198 in the bottom of exit chamber 172B and so to limit their accumulation. However, it must be noted that the above description has been in terms of the apparatus for depositing powder onto the upper belt 12 by means of the assembly of FIG. 6C, also shown in FIG. 1 as 152A. Gravity enters into the operation of the apparatus. The adaptation of FIG. 6D is required. If the equipment of FIG. 6C were simply inverted for use under lower belt 14 as in assembly 152B and FIG. 6D, the holes or apertures 174 and 192 would not entrain settled particles 196 and 198, since the particles would settle downward, away from the holes. Accordingly, in apparatus for the lower belt 14, the holes 192 and 174 must be low as in FIG. 6D. It will be seen that this move entails a repositioning of tubular dispenser 172 as in FIG. 6D, in order that the exit holes 174 will aim the airborne powder along the deflector surface 177. The corona-discharge wire 179 of either FIG. 6C or 6D is electrified as was the corona-discharge wire 179 of FIG. 6A.

The split construction of tube 172 into two parts 172A and 172B (FIGS. 6C and 6D) also makes possible the removal of internal burrs at the holes 174 during manufacture and, further, to regularize the sharpness of the entrance edges of these holes in order to regularize the corona-discharge effect when the tubular powder dispensing tube 172 is also the charging electrode as employed in the fourth embodiment (powered as in FIG. 6B). Split tube 172 comprising 172A and 172B with baffle 181 as just described is our most preferred embodiment to prevent powder accumulation in a tubular powder dispenser 172.

The problem of powder accumulation in dispensing tube 172 is also met in a second way, that is, by the internal-circulation mode which is that of increasing the speed of the powder-bearing air stream where it goes through a one-chamber tubular dispenser 172 (FIGS. 6 or 6A). However, this speeded air flow must be accomplished without incurring the undesirable local jet effects on powder deposition that would be caused by a high speed of the powder-charged air stream 175 going straight out of the holes 174. Moreover, the effect of this high speed air proceeding directly in reducing the settling of powder would be uneven, being nil at the closed far end 184 (FIG. 7) of tubular dispenser 172. Hence, to simply increase the amount of air in the airstream 318 or 419 is not a satisfactory way of preventing accumulation of powder in dispensing tube 172.

Figure 5A:
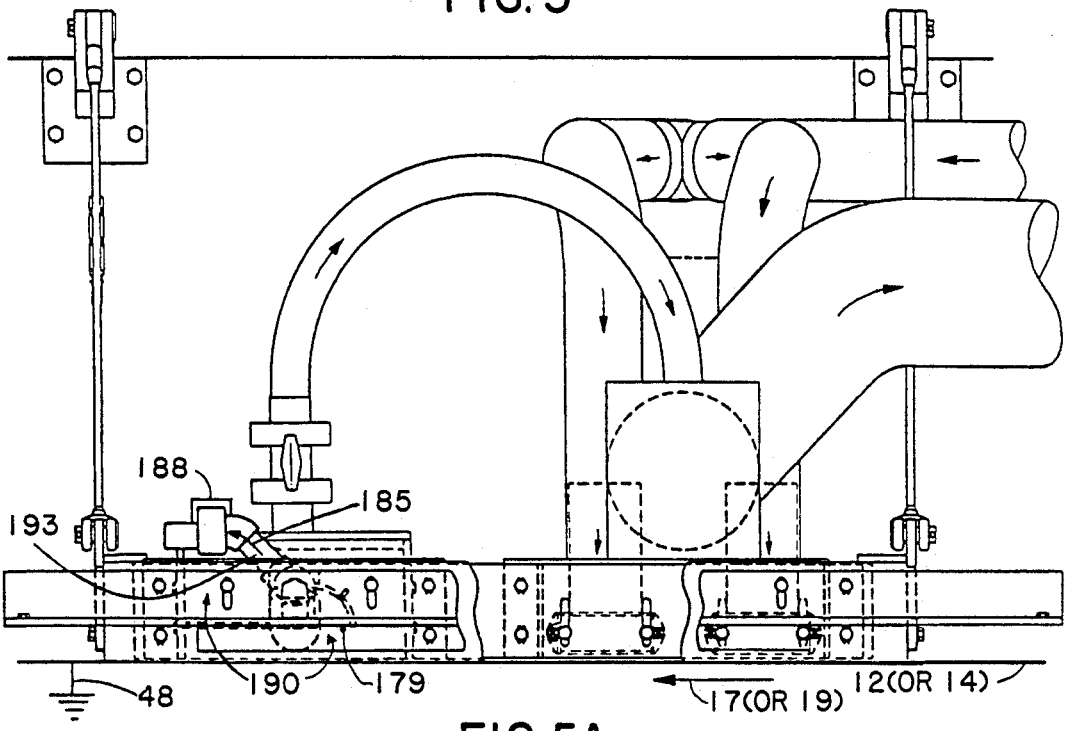
FIG. 5A is the same as FIG. 5 except that the electrostatic gun is replaced with a separate electrode, here a corona-discharge wire, and the single tubular dispenser forms part of a loop including a small blower for internal rapid circulation of the airborne powder. For clarity of illustration, reference numbers that appeared in FIG. 5 are not repeated.
Figure 7A:
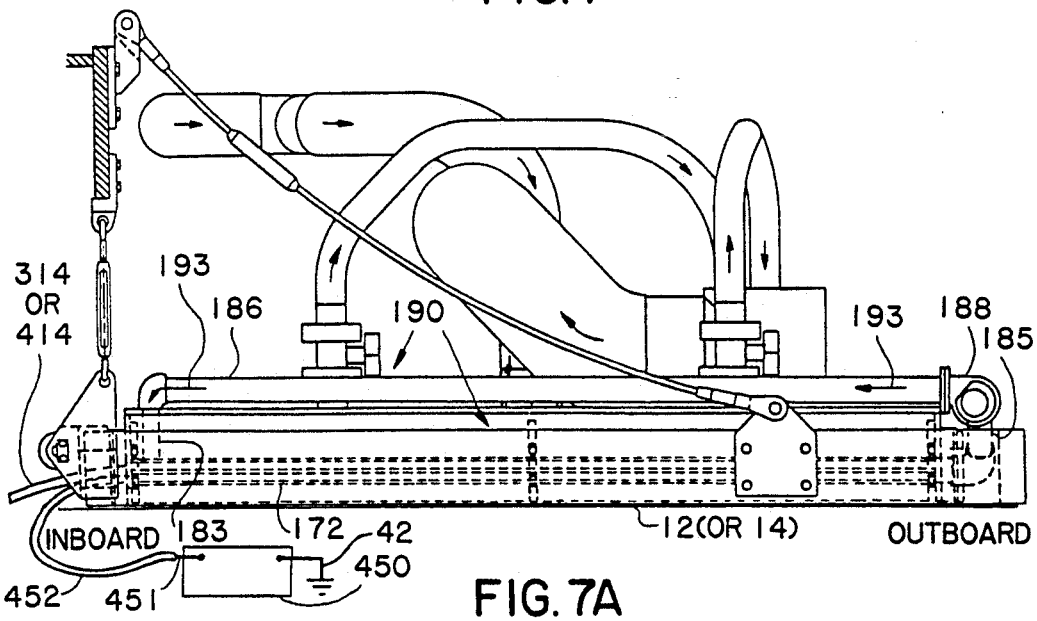
FIG. 7A is the same as FIG. 7 except that the electrostatic gun is replaced with alternate apparatus, and the single tubular dispenser forms part of a loop for internal rapid circulation of the airborne powder. For clarity of illustration, reference numbers that appeared in FIG. 7 are not repeated.

A satisfactory way to increase the air speed in one-chamber tubular dispenser 172 and so to keep powder airborne involves the providing of internal circulation through making the tube 172 part of a local loop 190, shown as tubing (FIGS. 5A, 7A and 8A). The return reach 186 is plumbed at 183 and 185 into opposite ends of the tube 172 for forming an inclusive flow circuit that includes the whole length of tube 172 in the loop 190. At one corner of the new plumbing 186 near the end connection 185, a small, electrically-driven squirrel-cage centrifugal blower 188 placed in-line in the loop 190 speedily moves the powder-bearing air flow 318 or 419 all the way through the tube 172 and through return reach 186 thereby preventing settling of the powder. The principle is to supply about the same circulating flow speed 183 to all regions along the length of the dispensing tube 172 without ever allowing the remote regions of the flow 183 to stagnate and in this way to avoid powder settlement within the dispensing tube 172. A fluidizing plenum similar in principle to that described above in connection with the hopper 302 (FIG. 9) is a sometimes useful option (not shown) to prevent certain powders from stagnating in the dispensing tube 172.

All of the above-described embodiments for adhering powder to casting belts incorporate the four following elements: (1) a conductive corona-discharge electrode, (2) powder dispenser, (3) bottomless spray box, and (4) arcade or buffer region along the perimeter of the bottomless spray box.

Figure 3:
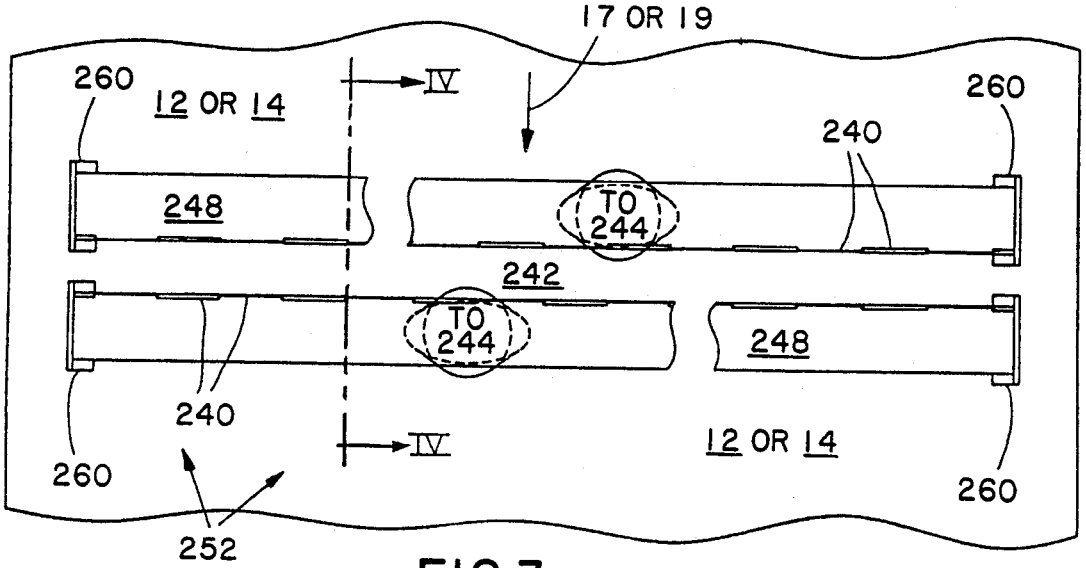
Figure 4:
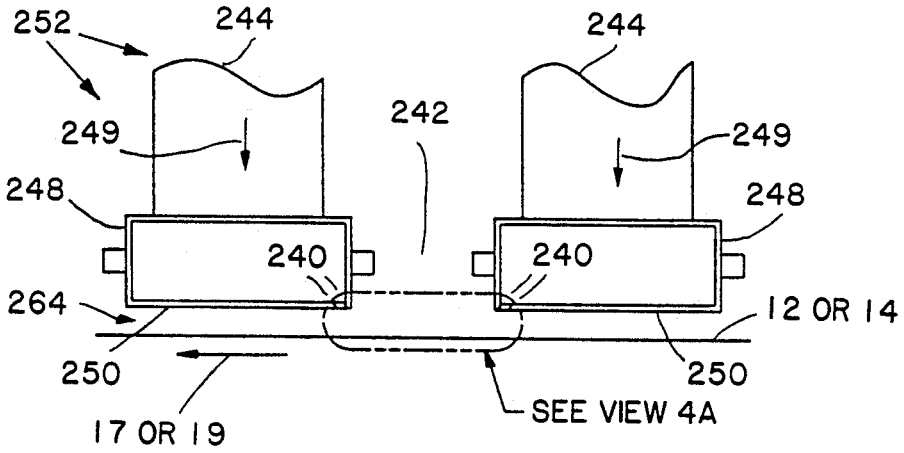

There is air-knife equipment for removing the powder or dust from a belt, as is generally indicated at 252 (FIGS. 1, 3, 4, 5 and 8). Air 249 (FIGS. 4, 5 and 8) from a single-stage centrifugal blower (not shown) at a pressure, for example, in the range of about 18 to about 26 inches of water column, enters a pair of air knife chambers 248, as shown in FIG. 4. This 249 air from the blower is fed into these air knife chambers through hoses 244 and creates air-knife jets 256 (FIG. 4A), thereby loosening the powder or dust which has previously been applied to the casting belt 12 or 14 and which already has been cast upon. A series of inclined jet slots 240 (see also FIG. 3) is cut in the wall 250 of each chamber 248 near a belt, alternating in two staggered rows (FIGS. 3 and 4). These slots as shown are about 0.025 of an inch (0.6 mm) wide. They are typically 3 to 4 inches (75 or 100 mm) long, with the effective part of the slots overlapping each other about 0.08 of an inch (2 millimeters) to ensure that no streaks of undislodged powder are left on the casting belt. The air knife chambers 248 are set at a gap of about 0.25 of an inch (6 millimeters) from the work face of the casting belt per gap 264. Removable end caps 260 on the chambers 248 enable cleaning the interior surfaces and also make possible the leveling of interior burrs during manufacture.

Figure 4A:
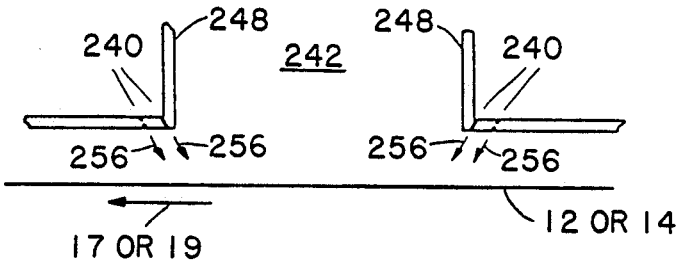
In FIG. 4A an enlarged partial sectional view shows the air jets of the air knife chambers. Section lines are omitted for clarity.

The air knife chambers 248 are enclosed in a non-conductive open-bottom plastic suction box 254 (FIGS. 5 and 8). Metal framing 268 with associated machine screws and brackets supports the apparatus of this invention on the casting machine 10 near the upper and lower casting belts 12 and 14. Between a casting belt and this open-bottom suction box 254 is a gap 262 (FIG. 5) of about 0.08 to 0.32 of an inch (about 2 to about 8 millimeters) through which air enters this suction box under an exit vacuum of about 12 inches (about 305 mm) of water column below atmospheric pressure inside the box 254, in order to keep dust from entering the atmosphere. As shown in FIG. 4A, there is about a 60-degree inclination of the slots 240 relative to the belt, and their relative converging inclinations direct most of the air jets 256 toward a plenum region 242 located within the suction box 254 between the two air knife chambers 248, from whence the dust-laden air is readily extracted through hose 280 to the aforesaid air filtering and collecting equipment (not shown).

FIGS. 1, 5, 7 and 8 show, as an upper-carriage assemblage 270 and a lower carriage assemblage 271, both the powder removal apparatus 252 and the powder distribution apparatus 152A and 152B in the single-tube method. The upper-carriage assemblage 270 is secured to carriage structure 272 of the machine 10 by means of cable assemblies 282 turnbuckles 284, brackets 288 and a pair of rollers 286 (FIG. 8). The relative height of the powder-distribution station 152A or 152B and the air-knife apparatus 252 is adjustable by means of screw slots 274 (FIG. 5) in the metal framing 2-6.8 while the whole assemblage 270 is adjusted down or up, toward or away from a casting belt by means of the turnbuckles 284. The pair of rollers 286 (FIG. 8) accommodate such up or down adjustment.

The corresponding lower assemblage 271 is supported by a cylinder 36 and a lever 34 with a rocker 38 interposed, turning on pivot pin 40.

An initial powder or dust distribution 70 (FIG. 2) or 171 (FIG. 6) is itself strikingly uniform, a fact that is visually observable when the film thickness of the distributed dust is adjusted to be semi-transparent. Unless continually replenished, the dust deposit or cushion becomes thinner and nonuniform as the casting belts turn and are cast upon repetitively. The normal mode of maintenance of the dust deposit 70 or 171 is by the electrostatic application of minute additional dustings. Such electrostatic re-depositings of dust particles afford the surprising and very advantageous quality of re-establishing a uniform, immediately useful self-healing of wear spots and scuffs without any interrupting of an ongoing casting operation.

If the resulting dust-cushion deposit 70 or 171 becomes contaminated or becomes too thick, it may be removed without difficulty, most conveniently with air jets 256 provided by the air-knife apparatus 252 described above. The dust deposit is then immediately renewed as for instance by the single-tube distributing station 152A or 152B, and the casting of desirable product is continued. With some powders, the air-knife removal is done routinely and is immediately followed by re-application.

However, we have observed that a continuous, very light reapplication of dust (without intentional removal) will automatically-self-adjustably patch over, and effectively repair, even a gross bare spot and will do so within a few revolutions of the casting belt. The patched area may not at once appear uniform, but the effect on the cast product is about as though it were uniform. Advantageously, the all-important requirement of an approximately uniform rate of heat transfer, in or out of the re-dusted previously bare spot, is evidently met by this overall touching-up procedure. This desirable uniformity is in marked contrast to prior-art top deposits or top dressings, where uniformity of heat transfer could not well be regained after a treated area of a casting belt had become worn.

Many finely divided refractory ceramic powders or dusts perform acceptably in the present method and apparatus. Powders or dusts should be refractory to the temperatures involved and non-wetting to the molten metal concerned. They should be thermally insulative and electrically insulative, at least at room temperature. Among the substances meeting these requirements on occasion are aluminum oxide, titanium dioxide, zirconium oxide, zircon, boron nitride, magnesium zirconate and aluminum silicate.

The above substances are relatively hard. Hard powders can be used but should preferably be of minute particle size. Some refractories are soft enough to ensure that subsequent rolling or drawing will crush them and break them into lesser, harmless minute pieces. Talc, mainly a magnesium silicate, is not hard and it is serviceable. Talc as sold for personal use has a laminated structure. Under our microscopic examination, the larger talc particles were seen microscopically as having a thin delicate three-dimensional structure of warped sheet material, rather like some dried leaves. Another soft substance is pyrogenic amorphous silicon dioxide (CAS Registry no. 112945-52-5 or no. 7631-86-9, where CAS stands for Chemical Abstracts Service). Although silicon dioxide is an inherently hard substance, it is rendered effectively soft in this form. Generally, the particles of these two soft substances are translucent or semi-transparent. Identifiable particles of these substances at 90 X magnification were seen to be within a size range of about 3 to about 300 micro-meters in their major dimension, with the vast majority of particles by count being below 50 micro-meters in their major dimension. When either of the above soft, large-particle substances are electrostatically applied, the collective tops of the particles present to the molten metal a roughness that we believe helps to account for their insulativity. Another suitable, effectively soft substance is zinc oxide.

Users of any of the above powdered substances should ask the manufacturers for health data. Electrostatic application of the above dry substances as dusts is not only convenient; it leads to results more uniform and serviceable in casting on flexible belts than through other methods of application.

OUR THEORY OF ELECTROSTATIC ADHERENCE OF REFRACTORY CERAMIC POWDERS OR DUSTS TO METALLIC CASTING BELTS

Corona discharge from a high-voltage thin-wire electrode is a means whereby refractory ceramic powder particles become charged as they go through and issue from an electrostatic spray gun or otherwise pass close to a charged electrode capable of creating corona discharge. In the several successful embodiments of the invention which have been described, and in the experiments performed to validate them, electrons are emitted from a negatively polarized electrode.

The electrons may charge the particles directly; however, they may rapidly become attached to air molecules to make negative Ions of molecules of nitrogen and perhaps especially of oxygen. These negative ions then bombard the refractory ceramic powder particles, which become negatively charged thereby.

According to our most recent experiments, a positively charged electrode will often serve as well as a negative one. This result corroborates the theory that only one stray electron will start an avalanche involving it (see reference by Miller). Under these conditions, the electrons flow to the electrode and the positive ions bombard the particles. We usually prefer the negative voltage; the behavior of the two kinds of charge is not quite identical.

Air flow through the electrostatic charging apparatus carries the charged powder particles and ions toward the casting belt. Electrostatic forces become important in the deposition of such charged particles only when they have reached a point about 0.8 of an inch (20 millimeters) from a ceramic-covered casting belt surface to be dusted, the metallic substrate of which is grounded.

In our attempts to design powder distribution apparatus, electrostatically charged powder particles in free flight away from the electrostatic charging apparatus lose their charge in two seconds or less under any condition known to us. This loss of charge occurs also when nitrogen or argon or carbon dioxide is used as the carrier gas in place of air. High humidity is thought to accelerate the loss but, in our observation, it happens even when the humidity is reduced to one part per million of water vapor.

When the electrostatically charged particles strike the belt being coated within less than about a second of free flight, many of the particles stick, being presumably still charged when they land. Once stuck, they remain stuck, resistant to moderate mouth-blowing apparently forever or until they are mechanically detached. This clinging persists on the work faces of either bare belts or thermally sprayed ceramic-coated belts.

Once the particle contacts the surface, one would expect the electrostatic charge to be dissipated either through contact with a grounded substrate or by continued bombardment by uncharged air molecules. The loss of the electrostatic charge is supported by the observation that, if the particles are detached from the substrate, by scraping for example, they have lost the ability to reattach themselves to the substrate. To account for the ability of the particle to remain attached to the belt after the electrostatic charge has been dissipated, the van der Waals force affords a plausible explanation. The van der Waals force is effective only at a distance on the order of atomic dimensions: the force is said to decrease inversely at something like the sixth power of the distance. Van der Waals force may be regarded as a special kind of electrostatic force, a kind that results from charges that stay dynamically captured within individual molecules and atoms of the refractory ceramic powder particles.

It follows from electrostatic theory that the inverse-square-law electrostatic force becomes strong as the refractory ceramic powder particles come in for a landing on the casting belt. During such a landing approach, the inverse-square force becomes large enough to cause a significantly high-speed impact, such that the van der Waals forces can then become effective in retention of the adhered charged particles on the casting belt. The high-speed-impacting particle thus would penetrate adsorbed air films and other obstructive films and would thereby come into intimate contact with the casting belt such that the van der Waals attractive force would become an effective adherent force. Perhaps optimum final alignments of each impact are piloted by local van der Waals forces.

In tending to accept this theoretical explanation, it is economical to suppose that the usual electrostatic forces do not persist anywhere but that they quickly dissipate themselves even from particles attached to the casting belt surface as the charges do when in free flight in mid-air, while the van der Waals forces remain effective. This theory based upon the effect of van der Waals forces avoids a paradox between sticking and nonsticking.

Alternatively, the molecules that originally held the electrostatic charge as Ions may continue to aid the attachment of the particle, even after the electrostatic charge is lost, by becoming part of the film of adsorbed gases attached to both the particle and the substrate.

Nevertheless, we cannot entirely rule out the existence of continuing electrostatic charges acting from the adhering particles and acting from protected positions thereon. A highly insulative particle is not charged uniformly. Rather, the charges remain at the points of random ionic or electronic impact and do not spread themselves around the particle (see reference by Hughes). This situation conceivably could allow for protected positions of electric charges.

Regardless of whether our explanatory theory is correct or not, the described advantageous successful results are obtained by employing the methods and apparatus of the present invention. We believe that the above-described advantageous results are not limited to the casting of any particular metal product. Our experiments show that these advantageous results of application of insulative refractory dust or powder are achieved in casting aluminum alloys and in casting copper in a twin-belt casting machine 10.

Although specific presently preferred embodiments of the invention have been disclosed herein in detail. It is to be understood that these examples of the invention have been described for purposes of illustration. This disclosure is not to be construed as limiting the scope of the invention, since the described methods and apparatus may be changed in details by those skilled in the art of continuous casting of metals, in order to adapt these methods and apparatus to be useful in particular casting machines or situations, without departing from the scope of the following claims.

We claim:

1. In a belt-type continuous metal-casting machine having a mold section and comprising at least one endless, thin, flexible, water-cooled, metallic casting belt, said belt having a work face and successively entering and leaving said mold section, the method for depositing and adhering a substantially uniform distribution of insulative material upon said work face for the purpose of obtaining controlled, uniform heat transfer during successive contacts with molten metal being continuously cast, said method comprising the steps of:

applying over said work face of said casting belt a temporary insulative dusting comprising dry, electrostatically charged, self-adhering, thermally and electrically insulative refractory powder particles, followed by the step of:

continuously casting molten metal upon said casting belt having said dusting of dry insulative powder particles thereon, said dry insulative powder particles being dispensed out of a plurality of apertures spaced across a width of said work face of the casting belt and thence guiding said dispensed particles along an inner surface of a deflector, the deflector sloping generally toward said work face of the casting belt, thereby:

directing said dry insulative powder particles to impinge upon said casting belt in a substantially uniform stream across the work face of said casting belt.

2. The method as claimed in claim 1, wherein:

said application of said dry, electrostatically charged, self-adhering, thermally and electrically insulative refractory powder particles to said work face of the casting belt is substantially continuous, while:

continuing to cast molten metal upon said casting belt without interruption.

3. The method as claimed in claim 1, in which said dry, electrostatically charged, self-adhering, thermally and electrically insulative refractory powder particles are charged, attracted to and adhered to the work face of the metallic casting belt through the steps of:

dispensing said powder particles airborne out of said apertures in a stream of air for guiding said airborne particles along the inner surface of said deflector into the region of an electrode, said electrode extending generally transversely across the work face of said casting belt and being spaced away from said work face across the width of said work face, connecting said electrode to a corona-discharge-productive power source, electrically grounding the casting belt, and revolving the casting belt past said electrode.

4. The method as claimed in claim 1, with the further steps of:

providing a tubular dispenser having said plurality of apertures through which said powder particles are dispensed in a stream of air, providing a plurality of chambers in said tubular dispenser, and directing air near to any settled powder that may accumulate in said tubular dispenser in order to entrain and remove said settled powder.

5. The method as claimed in claim 1, wherein:

said dusting of dry, electrostatically charged refractory powder particles comprises pyrogenic amorphous silicon dioxide within a size range of about 3 to about 300 micro-meters in a major dimension thereof, with a majority of the particles being below 50 micro-meters in their major dimension.

6. The method as claimed in claim 1, wherein:

said dusting of dry, electrostatically charged refractory powder particles comprises talc within a size range of about 3 to about 300 micro-meters in a major dimension thereof, with a majority of the particles being below 50 micro-meters in their major dimension.

7. The method as claimed in claim 1, wherein:

said dusting of dry, electrostatically charged refractory powder particles comprises zinc oxide within a size range of about 3 to about 300 micro-meters in a major dimension thereof, with a majority of the particles being below 50 micro-meters in their major dimension.

8. The method as claimed in claim 1, wherein:

said dusting of dry, electrostatically charged refractory powder particles comprises particles which lie generally within a size range of about 3 to about 300 micro-meters in a major dimension thereof, with a majority of the particles being below 50 micro-meters in their major dimension.

9. The method as claimed in claim 1, in which:

said dry powder particles are dispensed out of said apertures by an air pressure not greater than about one inch (about 25 mm) of water column.

10. The method as claimed in claim 1, in which:

said apertures are spaced across said width of said work face at a pitch of about 0.5 inch (about 13 mm).

11. In a belt-type continuous metal-casting machine having a mold section and comprising at least one endless, thin, flexible, water-cooled, metallic casting belt, said belt having a work face and successively entering and leaving said mold section, the method for depositing and adhering a substantially uniform distribution of insulative material upon said work face for the purpose of obtaining controlled, uniform heat transfer during successive contacts with molten metal being continuously cast, said method comprising the steps of:

applying over said work face of said casting belt a temporary insulative dusting comprising dry, electrostatically charged, self-adhering, thermally and electrically insulative refractory powder particles, followed by the step of:

continuously casting molten metal upon said casting belt having said dusting of dry insulative powder particles thereon, said metallic casting belt bearing on its work face a previously applied, fusion-bonded thermally sprayed permanent covering as a basing of refractory substance underneath said dusting of dry insulative powder particles, said dry insulative powder particles being dispensed out of a plurality of apertures spaced across a width of said work face of the casting belt and thence guiding said dispensed particles along an inner surface of a deflector, the deflector sloping generally toward said work face of the casting belt, thereby:

directing said dry insulative powder particles to impinge upon said casting belt in a substantially uniform stream across the work face of said casting belt.

12. The method as claimed in claim 11, wherein:

said application of said dry, electrostatically charged, self-adhering, thermally and electrically insulative refractory powder particles to said work face of the casting belt is substantially continuous, while:

continuing to cast molten metal upon said metallic casting belt without interruption.

13. The method as claimed in claim 11, in which said dry, electrostatically charged, self-adhering, thermally and electrically insulative refractory powder particles are charged, attracted to and adhered to the work face of the metallic casting belt through the steps of:

dispensing said powder particles airborne out of said apertures in a stream of air for guiding said airborne particles along the inner surface of said deflector into the region of an electrode, said electrode extending generally transversely across the work face of said casting belt and being spaced away from said work face across the width of said work face, connecting said electrode to a corona-discharge-productive power source, electrically grounding the casting belt, and revolving the casting belt past said electrode.

14. The method as claimed in claim 11 with the further steps of:

providing a tubular dispenser having said plurality of apertures through which said powder particles are dispensed in a stream of air, providing a plurality of chambers in said tubular dispenser, and directing air near to any settled powder that may accumulate in said tubular dispenser in order to entrain and remove said settled powder.

15. The method as claimed in claim 11, wherein:

said dusting of dry, electrostatically charged refractory powder particles comprises pyrogenic amorphous silicon dioxide within a size range of about 3 to about 300 micro-meters in a major dimension thereof, with a majority of the particles being below 50 micro-meters in their major dimension.

16. The method as claimed in claim 11, wherein:

said dusting of dry, electrostatically charged refractory powder particles comprises talc within a size range of about 3 to about 300 micro-meters in a major dimension thereof, with a majority of the particles being below 50 micro-meters in their major dimension.

17. The method as claimed in claim 11, wherein:

said dusting of dry, electrostatically charged refractory powder particles comprises talc within a size range of about 3 to about 300 micro-meters in a major dimension thereof, with a majority of the particles being below 50 micro-meters in their major dimension.

18. The method as claimed in claim 11, wherein:

said dusting of dry, electrostatically charged refractory powder particles comprises particles which lie generally within a size range of about 3 to about 300 micro-meters in a major dimension thereof, with a majority of the particles being below 50 micro-meters in their major dimension.

19. The method as claimed in claim 11, in which:

said dry powder particles are dispensed out of said apertures by an air pressure not greater than about one inch (about 25 mm) of water column.

20. The method as claimed in claim 11, in which:

said apertures are spaced across said width of said work face at a pitch of about 0.5 inch (about 13 mm).

21. In a belt-type continuous metal-casting machine having a mold section and comprising at least one endless, thin, flexible, water-cooled, metallic casting belt, said belt having a work face and successively entering and leaving said mold section, the method for depositing and adhering a substantially uniform distribution of insulative material upon said work face for the purpose of obtaining controlled, uniform heat transfer during successive contacts with molten metal being continuously cast, said method comprising the steps of:

applying over said work face of said casting belt a temporary insulative dusting comprising dry, electrostatically charged, self-adhering, thermally and electrically insulative refractory powder particles, followed by the step of:

continuously casting molten metal upon said casting belt having said dusting of dry insulative powder particles thereon, said dry, electrostatically charged, self-adhering, thermally and electrically insulative refractory powder particles being charged, attracted to and adhered to the work face of the metallic casting belt with the further steps of:

feeding said powder particles into a tubular dispenser, said tubular dispenser extending generally transversely across the work face of said casting belt and being spaced away from said work face across the width of said work face, connecting said tubular dispenser to a corona-discharge-productive power source, electrically grounding the casting belt, revolving the casting belt past said tubular dispenser.

22. The method as claimed in claim 13 with the further step of:

providing a loop of tubing including said tubular dispenser in said loop, interposing a blower in-line within said loop of tubing, circulating and recirculating airborne powder through said loop at relatively high speed through said loop, for reducing the amount of powder that remains settled and not airborne in said tubular dispenser.

23. In a belt-type continuous metal-casting machine having a mold section and comprising at least one endless, thin, flexible, water-cooled, metallic casting belt, said belt having a work face and successively entering and leaving said mold section, the method for depositing and adhering a substantially uniform distribution of insulative material upon said work face for the purpose of obtaining controlled, uniform heat transfer during successive contacts with molten metal being continuously cast, said method comprising the steps of:

applying over said work face of said casting belt a temporary insulative dusting comprising dry, electrostatically charged, self-adhering, thermally and electrically insulative refractory powder particles, followed by the step of:

continuously casting molten metal upon said casting belt having said dusting of dry insulative powder particles thereon, said metallic casting belt bearing on its work face a previously applied, fusion-bonded thermally sprayed permanent covering as a basing of refractory substance underneath said dusting of dry insulative powder particles, said dry, electrostatically charged, self-adhering, thermally and electrically insulative refractory powder particles being charged, attracted to and adhered to the work face of the metallic casting belt with the further steps of:

feeding said powder particles into a tubular dispenser, said tubular dispenser extending generally transversely across the work face of said casting belt and being spaced away from said work face across the width of said work face, connecting said tubular dispenser to a corona-discharge-productive power source, electrically grounding the casting belt, revolving the casting belt past said tubular dispenser.

24. The method as claimed in claim 14 with the further step of:

providing a loop of tubing including said tubular dispenser in said loop, interposing a blower in-line within said loop of tubing, circulating and recirculating airborne powder through said loop at relatively high speed through said loop, for reducing the amount of powder that remains settled and not airborne in said tubular dispenser.

25. In a belt-type continuous metal-casting machine having a mold section and comprising at least one endless, thin, flexible, water-cooled, metallic casting belt, said belt having a work face and successively entering and leaving said mold section, the method for depositing and adhering a substantially uniform distribution of insulative material upon said work face for the purpose of obtaining controlled, uniform heat transfer during successive contacts with molten metal being continuously cast, said method comprising the steps of:

applying over said work face of said casting belt a temporary insulative dusting comprising dry, electrostatically charged, self-adhering, thermally and electrically insulative refractory powder particles, followed by the step of:

continuously casting molten metal upon said casting belt having said dusting of dry insulative powder particles thereon, removing from said work face of the casting belt said dusting of dry, electrostatically charged, self-adhering, thermally and electrically insulative refractory powder particles, followed by the further step of:

reapplying more of said dry, electrostatically charged, self-adhering, thermally and electrically insulative refractory particles to said work face of the casting belt, while, continuing to cast molten metal upon said casting belt without interruption, said removing of said dusting of dry, initially electrostatically charged, self-adhering, thermally and electrically insulative refractory powder particles involving a step of, applying at least two inclined air-knife jets of air to said dusting, aiming said two inclined air-knife jets in converging relationship toward said dusting, exhausting a region between said two inclined air-knife jets.

26. The method as claimed in claim 25, wherein:

said metallic casting belt bearing on its work face a previously applied, fusion-bonded thermally sprayed permanent covering as a basing of refractory substance underneath said dusting of dry insulative powder particles.

27. A mold wall suitable for use in a continuous molten-metal-casting machine, which mold wall comprises an endless, thin, flexible, water-cooled, metallic casting belt, which belt bears upon its work face:

a temporary dry dust cushion comprising:

dry, refractory powder particles, said particles having been carried by an air stream generally in a first direction, with said air stream having been redirected generally to a second direction for carrying said particles generally in said second direction more directly toward the mold wall than said first direction, said particles having been electrostatically charged by corona discharge prior to applying the charged particles to said work face for forming said dry heat cushion on said work face, said particles being non-wetting to molten metal to be cast against said dust cushion on said work face, and said particles being adhered to said work face by their having been electrostatically charged prior to their application to said work face.

28. A mold wall as claimed in claim 27, wherein:

said metallic casting belt bears on its work face a previously-applied, fusion-bonded, thermally-sprayed permanent covering as a basing comprising electrically insulative refractory substance underneath said dry dust cushion.

29. A mold wall as claimed in claim 28, wherein:
said dry dust cushion of dry electrostatically applied refractory powder particles comprises pyrogenic amorphous silicon dioxide within a size range of about 3 to about 300 micro-meters in a major dimension thereof, with a majority of the particles being below 50 micro-meters in their major dimension.

30. A mold wall as claimed in claim 28, wherein:
said dry dust cushion of dry electrostatically applied refractory powder particles comprises talc within a size range of about 3 to about 300 micro-meters in a major dimension thereof, with a majority of the particles being below 50 micro-meters in their major dimension.

31. A mold wall as claimed in claim 28, in which:
said dry electrostatically applied refractory powder particles are generally in a size range of about 3 to about 300 micro-meters in their major dimension within a size range of about 3 to about 300 micro-meters in a major dimension thereof, with a majority of the particles being below 50 micro-meters in their major dimension.

32. A mold wall as claimed in claim 27, wherein:
said metallic casting belt bears upon its work face;
a temporary dry dust cushion comprising zinc oxide particles electrostatically applied to said work face.

33. A mold wall as claimed in claim 32, wherein:
said metallic casting belt bears on its work face a previously-applied, fusion-bonded, thermally-sprayed permanent covering as a basing comprising electrically insulative refractory substance underneath said dry dust cushion comprising zinc oxide particles electrostatically applied to said work face.

34. A mold wall as claimed in claim 27, wherein:
said dry dust cushion of dry electrostatically applied refractory powder particles comprises pyrogenic amorphous silicon dioxide within a size range of about 3 to about 300 micro-meters in a major dimension thereof, with a majority of the particles being below 50 micro-meters in their major dimension.

35. A mold wall as claimed in claim 27, wherein:
said dry dust cushion of dry, electrostatically applied refractory powder particles comprises talc within a size range of about 3 to about 300 micro-meters in a major dimension thereof, with a majority of the particles being below 50 micro-meters in their major dimension.

36. A mold wall as claimed in claim 27, in which:
said dry electrostatically applied refractory powder particles are generally in a size range of about 3 to about 300 micro-meters in a major dimension within a size range of about 3 to about 300 micro-meters in a major dimension thereof, with a majority of the particles being below 50 micro-meters in their major dimension.

37. A mold wall as claimed in claim 27, wherein:
said dry dust cushion of dry electrostatically applied refractory powder particles comprises boron nitride particles continuously electrostatically applied to said thin, flexible, water-cooled, metallic casting belt as said belt is continuously revolved and molten metal is being continuously cast on said dry dust cushion.

38. In a belt-type continuous metal-casting machine comprising at least one endless, thin, flexible, water-cooled, metallic casting belt having a work face, apparatus for applying dry, airborne, thermally and electrically insulative refractory powder particles to the work face of said metallic casting belt, said apparatus comprising:
at least one conductive electrode connected to a corona-discharge-productive power source,
drive means for continuously moving said flexible metallic casting belt past said electrode,
grounding means for electrically grounding said flexible metallic casting belt,
said electrode extending generally transversely across the work face of said casting belt and being spaced away from said work face across the width of said work face,
means for feeding said airborne powder particles into the region of said charged electrode for charging said airborne powder particles to be attracted to and to adhere to the work face of said metallic casting belt,
said electrode and said means for feeding powder particles being housed in a bottomless spray box,
said bottomless spray box having a top wall and side walls,
said side walls being spaced away from the work face of the casting belt for providing a clearance gap between each side wall and the work face of the casting belt, and
suction means associated with said bottomless spray box for providing gaseous pressure within said bottomless spray box below atmosphere pressure.

39. Apparatus as claimed in claim 38, in which:
said clearance gaps between said side walls and said work face are about 0.08 to about 0.32 of an inch (about 2 to about 8 millimeters).

40. Apparatus as claimed in claim 39, wherein:
said suction is no more than about three inches (about 75 mm) of water column.

41. Apparatus for applying thermally and electrically insulative dry refractory powder particles onto a work face of a flexible metallic belt of a continuous metal casting machine comprising:
a plurality of electrostatic spray guns aimed at the work face of the casting belt,
said spray guns being spaced generally uniformly across said work face and having discharge snouts spaced at substantially equal distances from said work face,
a bottomless spray box positioned around portions of each of said spray guns including at least their discharge snouts,
said bottomless spray box having a top wall and side walls,
said side walls being spaced away from the work face of the casting belt for providing a clearance gap between each side wall and the work face of the casting belt,
an arcade along the perimeter of said bottomless spray box,
said arcade being spaced away from the work face of the casting belt for providing a clearance gap between a perimeter of said arcade and the work face of the casting belt, and,
suction means associated with said arcade for providing gaseous pressure within said arcade below atmospheric pressure.

42. Apparatus as claimed in claim 41, in which:

said clearance gaps between said perimeter of said arcade and said work face and between said side walls and said work face are about 0.08 to about 0.32 of an inch (about 2 to about 8 millimeters).

43. Apparatus for applying thermally and electrically insulative refractory powder particles onto a work face of a flexible metallic casting belt of a continuous metal casting machine comprising:

a deflector having an inside curved surface sloping toward said work face of the metallic casting belt, a tubular dispenser having a plurality of apertures in a wall of said tube, said tubular dispenser being positioned near the inside curved surface of said deflector, said apertures being aimed along said inside surface, and, an electrostatic spray gun directed into said tubular dispenser.

44. Apparatus for applying thermally and electrically insulative refractory powder particles onto a work face of a flexible metallic casting belt of a continuous metal casting machine comprising:

a curved deflector having an inside concave surface facing generally toward said work face of the metallic casting belt, a tubular dispenser, a wall of which tube has a plurality of apertures, said tubular dispenser being positioned near said inside concave surface of said curved deflector, said apertures being aimed to impinge said powder particles at a low angle against said curved inside concave surface of said deflector, and a corona-discharge-productive power supply connected to an electrode positioned near to said inside concave surface of said deflector.

45. Apparatus as claimed in claim 44, in which:

said tubular dispenser is split longitudinally Into an antechamber with means for introducing said powder particles thereinto, and a dispensing chamber for emitting such powder particles into the atmosphere, there being interposed between said two chambers a baffle which defines within itself a plurality of apertures which are at a low position relative to the Earth, said dispensing chamber further comprising a plurality of exit apertures which are in an outside wall of said dispensing chamber and low with respect to the Earth.

46. Apparatus as claimed in claim 44, in which:

said tubular dispenser is split longitudinally into an through which airborne powder may be circulated and recirculated at relatively high speed by a blower interposed within said loop of tubing.

47. Apparatus as claimed in claim 44, in which:

said apertures are spaced along said tubular dispenser at a pitch of about 0.5 inch (about 13 mm).

48. Apparatus as claimed in claim 44, in which:

said apertures are round and have a diameter of about 0.062 of an inch (about 1.58 mm).

49. Apparatus as claimed in claim 44, in which:

said apertures are round and have a diameter of about 0.062 of an inch (about 1.58 mm), and said apertures are spaced along said tubular dispenser at a pitch of about 0.5 inch (about 13 mm).

50. Apparatus as claimed in claim 44, in which:

said tubular dispenser includes an antechamber with means for introducing said powder particles thereinto and a dispensing chamber, said plurality of apertures are in a wall of said dispensing chamber, said tubular dispenser has a baffle interposed between said antechamber and said dispensing chamber, and said baffle has a plurality of holes communicating between said antechamber and said dispensing chamber for air flow to carry said powder particles from said antechamber through said holes into said dispensing chamber and thence out through said apertures.

51. Apparatus as claimed in claim 50, in which:

the total of the area of said holes is comparable to the total of the area of said apertures.

52. In a belt-type continuous metal-casting machine having a mold section and comprising at least one endless, thin, flexible, water-cooled, metallic casting belt having upon its work face electrostatically adhered powder, the apparatus for removing said powder comprising:

a pair of air knives separated by an exhaust plenum toward which air escaping from both of said air knives is generally directed.

53. Apparatus for applying electrostatically charged refractory powder particles to a revolvable, electrically conductive, electrically grounded mold in a continuous casting machine comprising:

a tubular dispenser extending across a casting width of said mold and being spaced from the mold, said tubular dispenser having a plurality of apertures spaced across said casting width, means for feeding dry, airborne, refractory powder particles into said tubular dispenser, a corona discharge electrode extending across said casting width and being spaced from the mold, a deflector positioned near said tubular dispenser, said deflector extending across said casting width and being spaced from the mold, said deflector having a surface sloping generally toward said mold, said apertures directing an airborne stream of dry, refractory powder particles moving toward said sloping surface for becoming redirected by said surface toward the mold, and said airborne stream of dry, refractory powder particles moving past said corona discharge electrode for electrostatically charging said particles prior to their application to the mold.

54. Apparatus as claimed in claim 53, in which:

said tubular dispenser includes a plurality of chambers, and means are provided in said chambers for enabling air flow to entrain settled powder particles for limiting their accumulation.

55. Apparatus as claimed in claim 54, in which:

said tubular dispenser includes an antechamber and a dispensing chamber, said means for feeding dry, airborne, refractory powder particles into said tubular dispenser feeds into said antechamber, said apertures are in an external wall of said dispensing chamber, said tubular dispenser has a baffle between said antechamber and said dispensing chamber, said baffle has holes for feeding dry, airborne, refractory powder particles from said antechamber into said dispensing chamber and thence out of said apertures, and said means in said chambers for enabling air flow to entrain settled powder particles for limiting their accumulation includes said holes in said baffle being arranged for air flow through said holes to entrain settled powder particles.

56. Apparatus as claimed in claim 53, in which:

said tubular dispenser includes an antechamber and a dispensing chamber, said means for feeding dry, airborne, refractory powder particles into said tubular dispenser feeds into said antechamber, said apertures are in an external wall of said dispensing chamber, said tubular dispenser has a baffle between said antechamber and said dispensing chamber, and said baffle has holes for feeding dry, airborne, refractory powder particles from said antechamber into said dispensing chamber and thence out of said apertures.

57. Apparatus as claimed in claim 56, in which:

said casting machine defines a pass line with said baffle being oriented perpendicular to the pass line, and said holes are positioned low in said baffle near a lower portion of said tubular dispenser where powder tends to settle under influence of gravity.

58. Apparatus as claimed in claim 56, in which:

said tubular dispenser includes means for air flow to entrain settled powder particles for limiting accumulation of settled powder particles.

59. Apparatus as claimed in claim 53, in which:

said corona discharge electrode is positioned closer to said deflector than to said mold.

* * * * *